United States Patent [19]
Horning et al.
[11] 4,258,796
[45] Mar. 31, 1981

[54] EARTH DRILLING APPARATUS

[75] Inventors: Frederick G. Horning; John M. Pozniko, both of Salem; Karl H. Welch, Salineville, all of Ohio

[73] Assignee: The Salem Tool Company, Salem, Ohio

[21] Appl. No.: 929,727

[22] Filed: Jul. 31, 1978

[51] Int. Cl.[3] ..... E21B 7/02; E21B 19/02
[52] U.S. Cl. ..... 175/52; 175/85; 175/320; 173/25; 173/28; 173/164; 173/147
[58] Field of Search ..... 173/25, 28, 164, 27; 175/85, 320, 52; 211/60 S

[56] References Cited

U.S. PATENT DOCUMENTS

| | | | |
|---|---|---|---|
| 2,334,312 | 11/1943 | Caldwell | 173/164 |
| 2,972,388 | 2/1961 | Thornburg | 173/28 |
| 3,012,619 | 12/1961 | Farque | 173/28 X |
| 3,874,196 | 4/1975 | Hisey et al. | 175/195 |
| 3,985,189 | 10/1976 | Jahnke | 173/164 |
| 4,128,135 | 12/1978 | Mitchhart | 175/285 |

*Primary Examiner*—William F. Pate, III
*Attorney, Agent, or Firm*—Pearne, Gordon, Sessions, McCoy & Granger

[57] ABSTRACT

Disclosed is apparatus for drilling or boring a hole in the earth, as for forming blast holes. The apparatus disclosed is of the self-propelled mobile type having at one end a driver cab and at the other end drilling apparatus including a drill storage and handling rack adapted to store drill rods and as required to bring them into alignment with the drilling axis to form a drill string and to remove the drill rods from the drill string. The apparatus also supplies air to and through the drill string to blow out debris from the drilled hole. The apparatus includes a unique and efficient type of mechanism for rotating the drill rack to bring drill rods to or remove them from the drill string. Also disclosed is a unique type of drill rod particularly adaptable for use in the apparatus.

25 Claims, 45 Drawing Figures

6
74
76
66
89
3
R
S
A
96
96
13
8
76
4
75
66
125
5
2
126
13
125
Y
2
123
R
5
126
4
66
X
B
68
6
65
3
68
68
124
96
70
13
12
12
1
11
10
11
14
13

FIG. 9
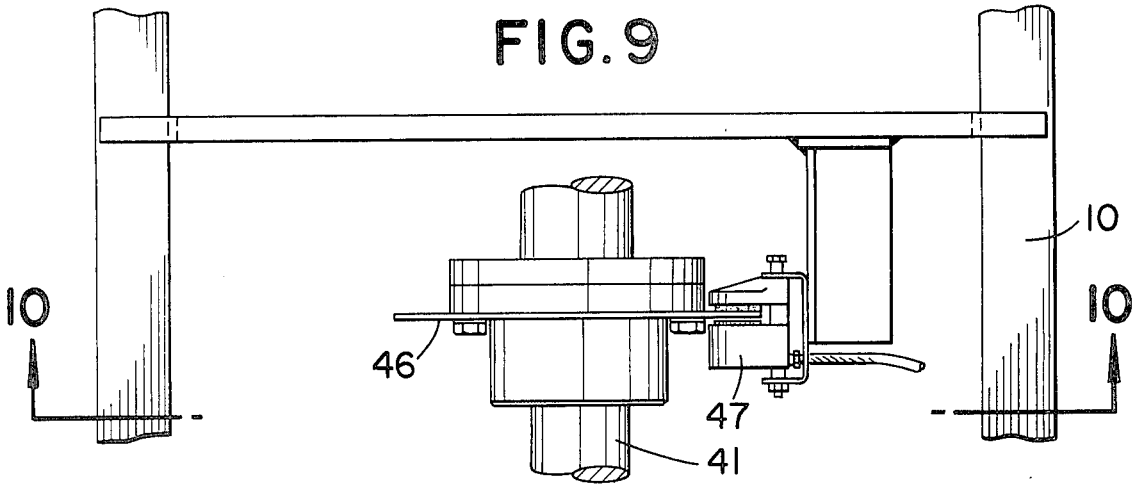
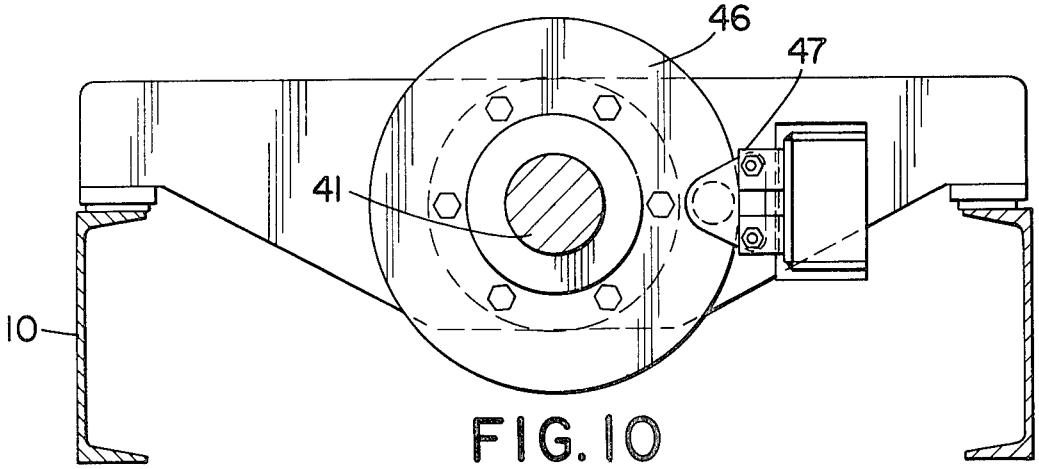
FIG. 10
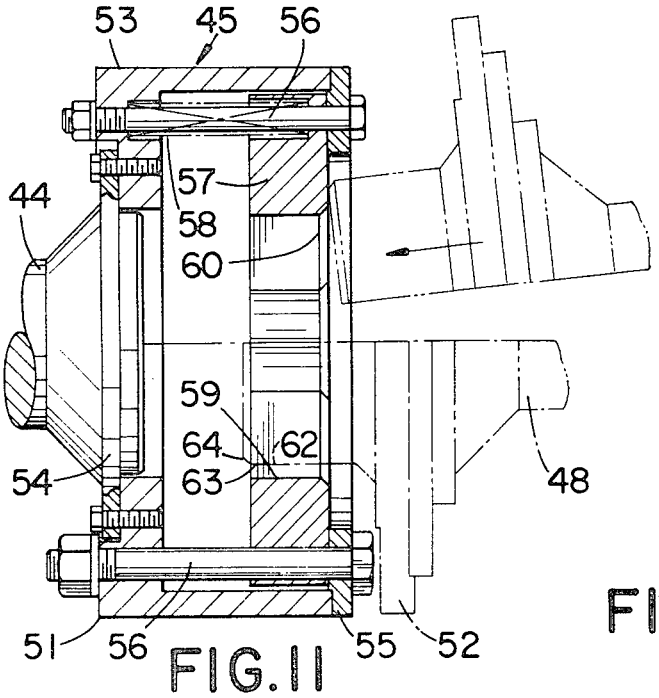
FIG. 11
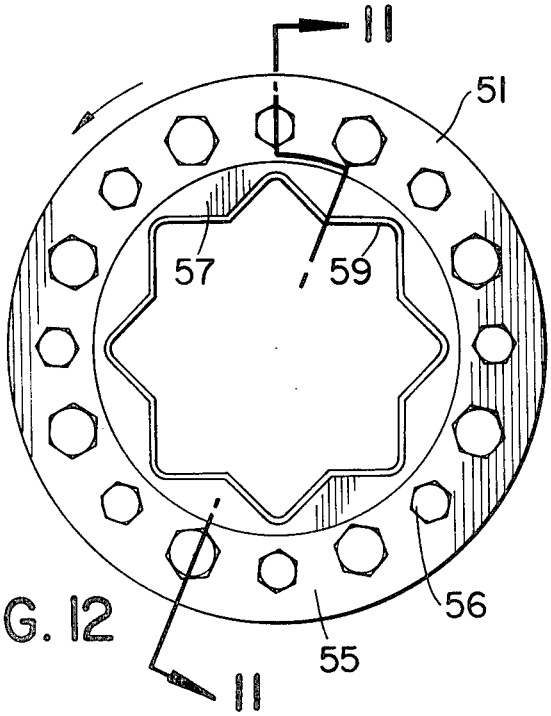
FIG. 12

FIG. 31
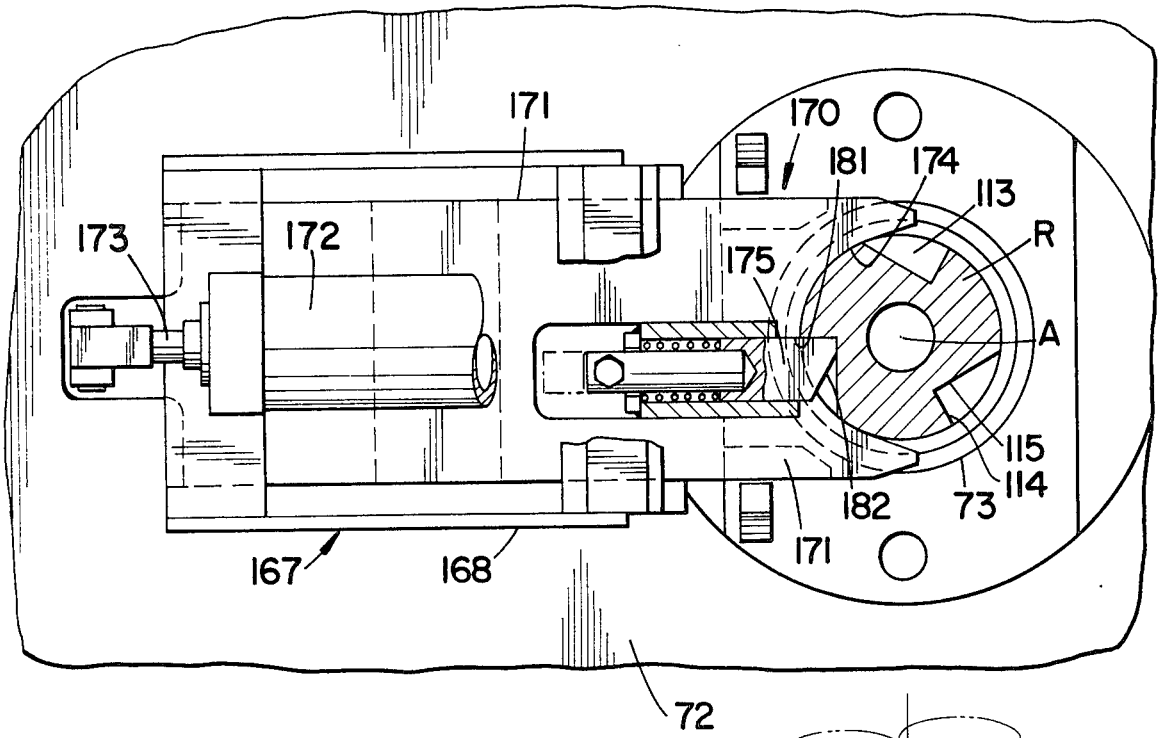
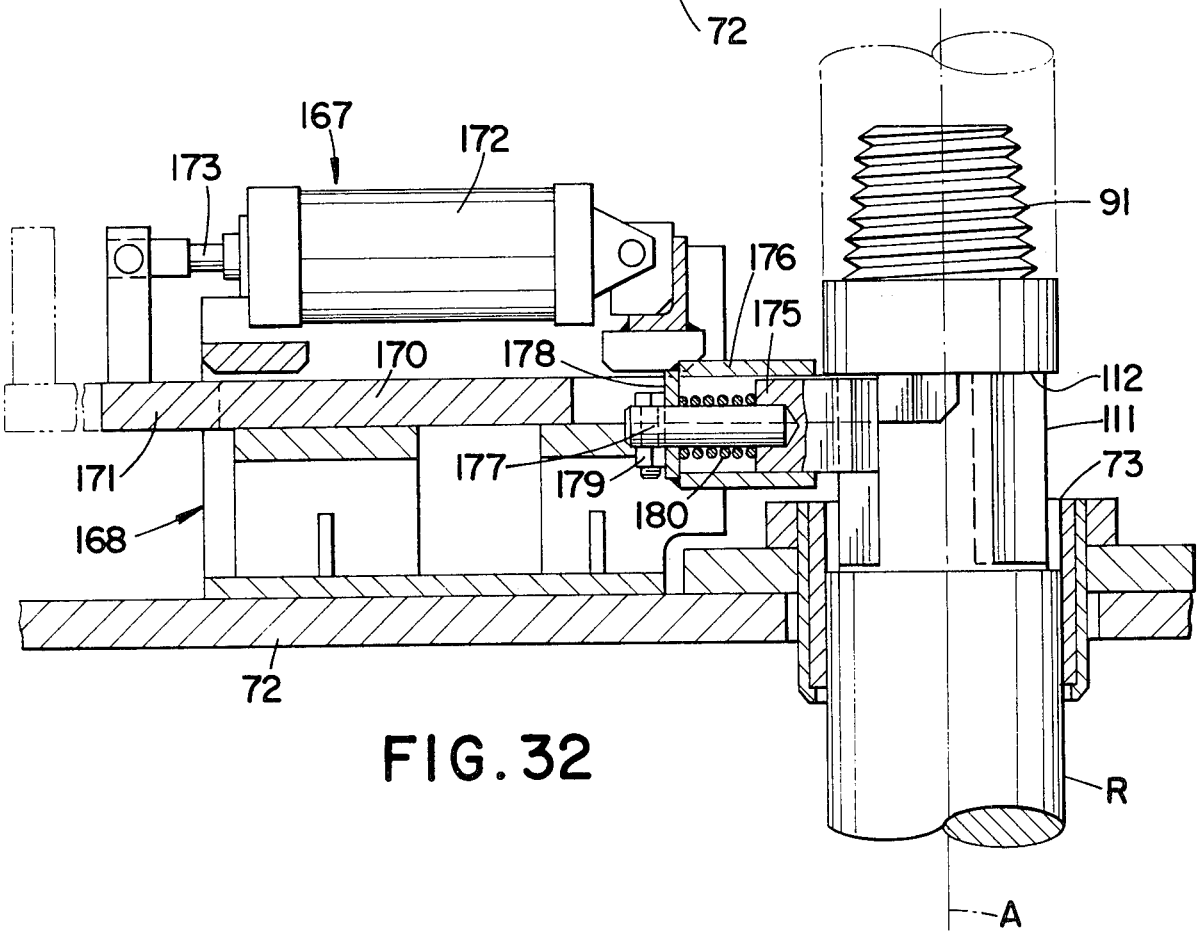
FIG. 32

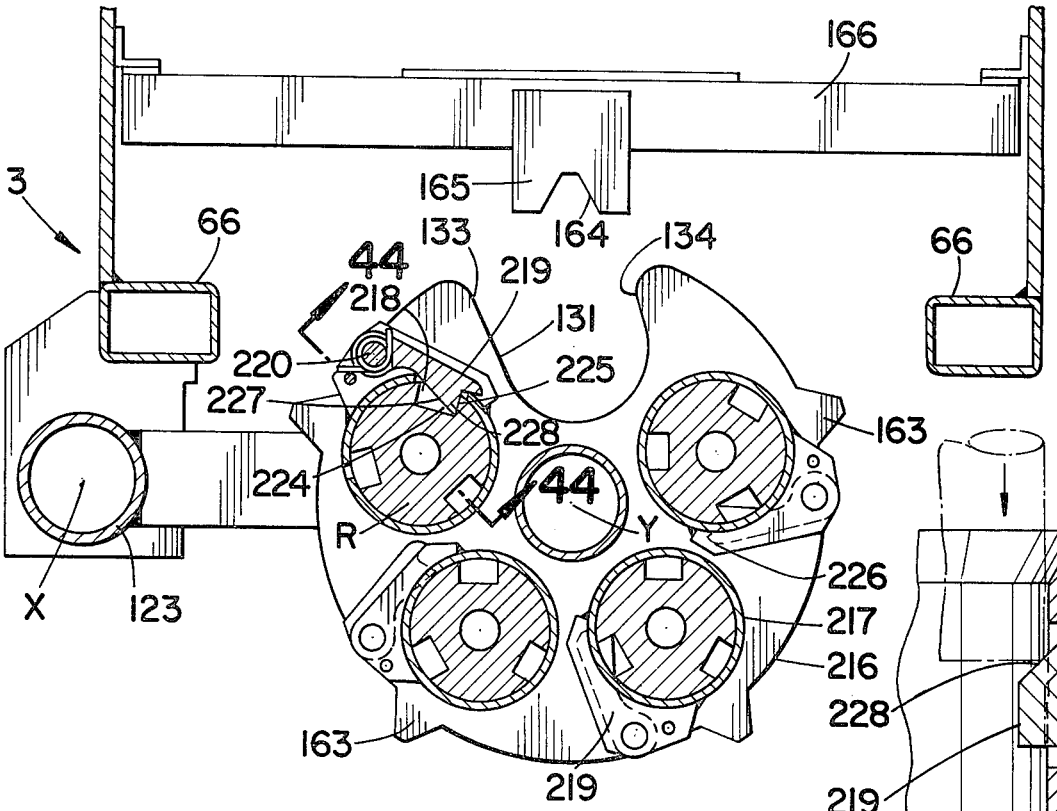
FIG. 42
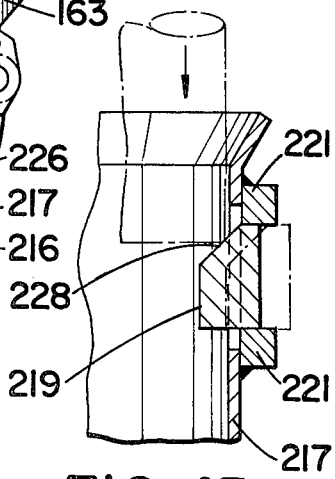
FIG. 45
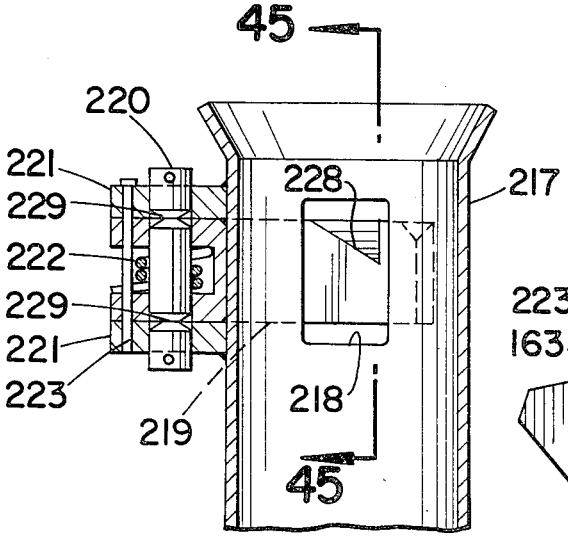
FIG. 44
FIG. 43
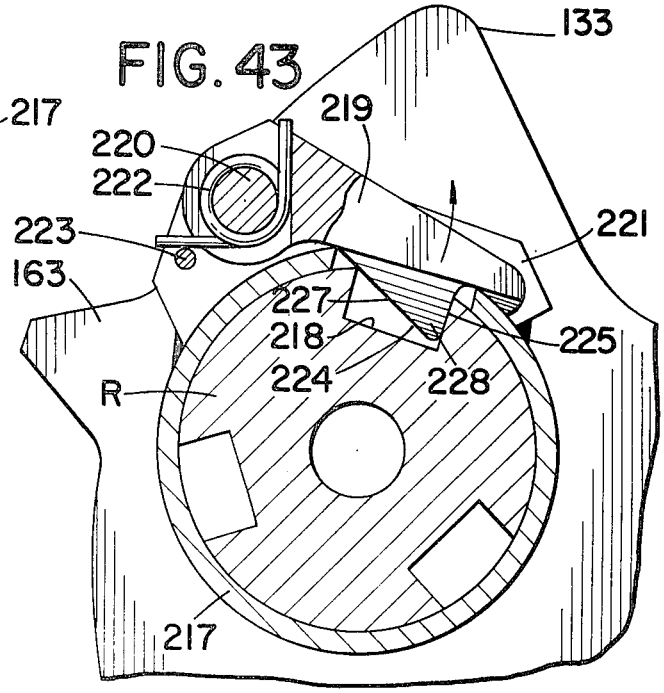

EARTH DRILLING APPARATUS

BACKGROUND OF THE INVENTION

1. Field of the Invention

This invention relates to drilling or boring apparatus and more particularly to means for drilling or boring holes downwardly into the earth.

2. Description of the Prior Art

This invention provides particular advantages when employed in mobile self-propelled drilling apparatus that may be moved from one location to another to drill holes in the earth at different locations as for drilling blast holes; the invention therefore will be described in connection with such apparatus.

Heretofore, drilling apparatus of this type has often comprised a mobile vehicle body having power means for propelling the apparatus, and at one end a drilling mast adapted to be raised to an upright position to permit drilling and to be lowered to a generally horizontal position to facilitate travel of the vehicle from one location to another. The mast has had associated with it means for storing drill rods and placing them into a location where they could be incorporated into a drill string and for removing the drill rods from the drill string and storing them.

In most apparatus of this type, the drill rods are quite heavy, each often weighing several hundred pounds and being 12 to 20 feet long or even longer. The size and weight of these drill rods have prevented handling of the rods manually. Therefore, it is desirable that mechanical means be provided to put stored drill rods into proper position to be connected in the drill string for drilling purposes, and after drilling is finished to disconnect the drill rods from the drill string and store them in drill storage means on the apparatus. Moreover, it is very desirable that this operation be performed rapidly in order to reduce costs of labor, fuel, and to obtain a high rate of usage of the apparatus which usually is quite expensive. It is also important that the handling of the drill rods and the drilling operation be performed with a maximum of safety to operators.

Heretofore, various types of mechanical means have been provided or proposed for handling and storing the drill rods but in general such means has not been as effective as desired, for various reasons.

Prior drilling apparatus, and particularly the means for handling and storing the drill rods have often been excessively complicated and liable to costly breakdowns, particularly under the severe conditions of use in the field in which the apparatus is subjected to substantial forces and to dust and abrasion. Prior apparatus often has not been as dependable for these and other reasons, and hence has resulted in added costs of drilling. Often prior apparatus has not operated sufficiently automatically to accurately place the drill rods for inclusion in the drill string, and when the drill rods are removed to place them in storage; often such prior apparatus has required considerable manipulation and control by the operator. These problems have been intensified because of the large inertial forces involved in starting and halting movement of groups of heavy drill rods in the handling and storage means.

SUMMARY OF THE INVENTION

It is an object of the invention to provide drilling apparatus that satisfies all or as many as desired of the above features of satisfactory and economical drilling, and that overcomes all or as many as desired of the above disadvantages.

In one aspect, the apparatus of the invention comprises mobile drilling apparatus having a vehicle body carrying power means for propelling the apparatus and for driving the drilling equipment, and having a drilling mast adapted to be raised to an upright vertical position and to be lowered to a generally horizontal position for traveling, the power means on the vehicle body including power train means adapted to provide power to propel the apparatus from one location to another, to provide power for rotating and moving vertically a drill head which drives the drill string for drilling, and to provide power for auxiliary equipment such as to provide air under pressure to pass through the drill string and into the drilled hole to remove dust and debris.

In another aspect, the apparatus provides a unique and effective mechanical means for supplying power to the drilling head for rotating the drill string, which means includes disconnect means which can automatically establish as the mast is moved to its upright position a driving connection between the power means on the vehicle body and means on the mast for supplying power to the drilling head, and which can automatically disconnect such power means when the mast is moved to its horizontal position.

Another aspect of the invention provides improved drill rod storage and handling means that is mounted on the mast, and embodies a rotatable storage rack that is mounted on the mast and a geneva wheel mechanism operating between the mast and the rack that accurately and precisely rotates the storage rack to a position where each of a plurality of drill rods carried by the storage rack can be sequentially located with its axis along the drilling axis and that makes possible the automatic sequential connections of such drill rods to a drilling head on the mast and to lower elements such as lower drill rods and also makes possible ready automatic sequential removal of drill rods from the drill string and placing of the rods in the storage rack.

The invention also provides improved means for holding a drill rod against rotation while another element such as the drilling head that is connected to the rod by a threaded joint is rotated to disconnect the joint, and also means for turning a drill rod about its axis sufficiently to loosen a threaded joint between the drill rod and another element such as another drill rod.

The invention also provides an improved drill rod, which may be advantageously used in apparatus of the type described above, which embodies configurations making it readily possible to remove the drill rod from a storage rack and place it in a drill string, to remove the rod from the string and store it, to hold the rod against rotation for disconnecting purposes, and to permit the rod to be turned to loosen a threaded connection by which it is connected to another element, disconnect the drill rod from the drilling head and from elements below the drill rod such as lower drill rods or cutting head.

BRIEF DESCRIPTION OF THE DRAWINGS

These and other objects, features and advantages of the invention will become apparent from the following description of a preferred apparatus and preferred drill rod embodying the invention, in connection with the following drawings in which:

FIG. 9 is a plan to a still larger scale showing braking means included in the driving means;

FIG. 10 is an elevation of the braking means from line 10—10 of FIG. 9;

FIG. 11 is a section to a larger scale along line 11—11 of FIG. 12, illustrating structure and operation of means providing a separable connection between the drive means of FIGS. 7 to 10 and drive means on the mast for the drilling head;

FIG. 12 is an end view of the female portion of the drive means of FIG. 11;

FIG. 31 is a plan view of means mounted on a lower portion of the mast for engaging a drill rod to prevent its rotation when a threaded member above it is being unscrewed, the scale being considerably larger than that of FIGS. 13 and 14;

FIG. 32 is a side view of FIG. 31, with parts sectioned;

FIG. 42 is a plan view of the lower portion of another drill rack embodying the invention that may be used in place of that shown in FIG. 26 and associated Figures;

FIG. 43 is a plan section, to a scale larger than that of FIG. 42, of one of the cup members, with a drill rod in it that is engaged by the latch member of the cup member;

FIG. 44 is a section along line 44—44 of FIG. 42, to a larger scale, one of the cup members of FIG. 42 for holding the lower end of a drill rod, the cup member being empty of a drill rod; and FIG. 45 is a view along line 45—45 of FIG. 44 showing an inclined surface of the latch member that causes it to retract when a drill rod enters the cup member.

DESCRIPTION OF PREFERRED EMBODIMENTS

Apparatus

The drilling apparatus illustrated in FIGS. 1-34 as embodying the invention comprises mobile vehicle 1 carrying drilling means 2.

Figures 1, 2:
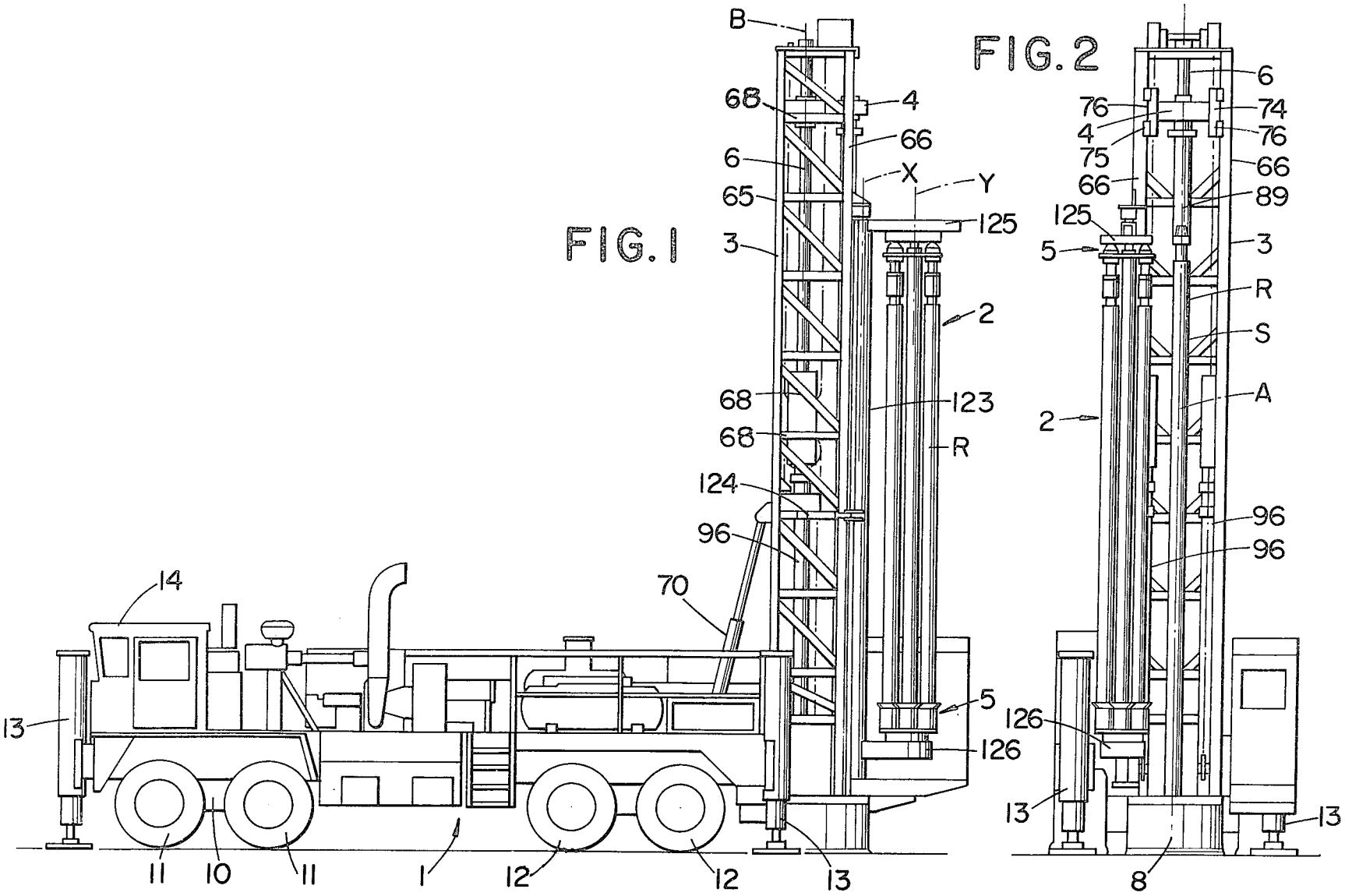
FIG. 1 is a side elevation of illustrative mobile drilling apparatus of the invention, the mast being shown in its upright position and the stabilizing jacks shown as extended and contacting the earth to stabilize the apparatus for drilling.
FIG. 2 is a view from the right-hand end of the apparatus of FIG. 1, to the same scale.
Figure 4:
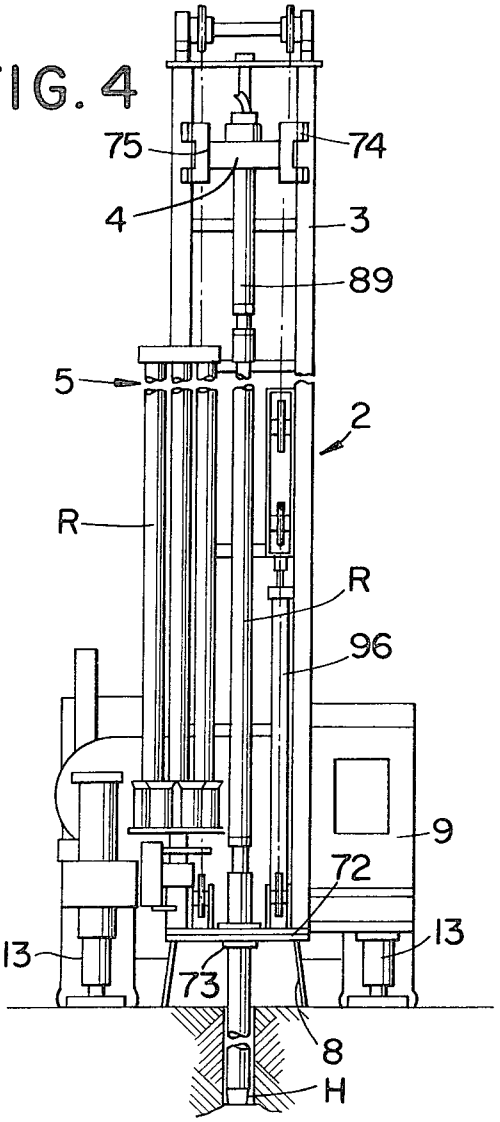
FIG. 4 is a view from the right-hand end of the apparatus of FIG. 3, to the same scale.
Figure 3:
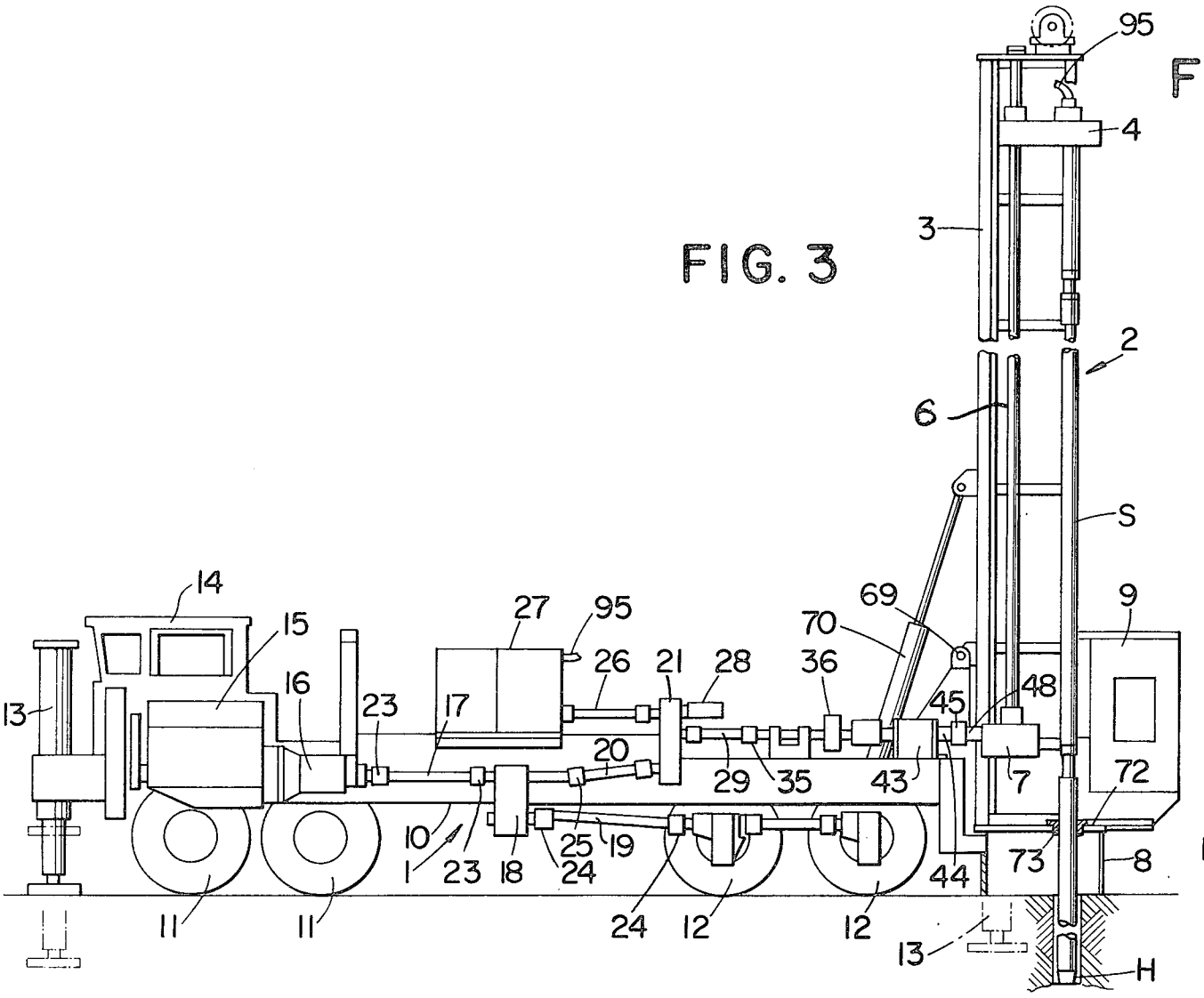
FIG. 3 is a vertical sectional view of the apparatus of FIG. 1 but to a slightly larger scale.
Figure 5:
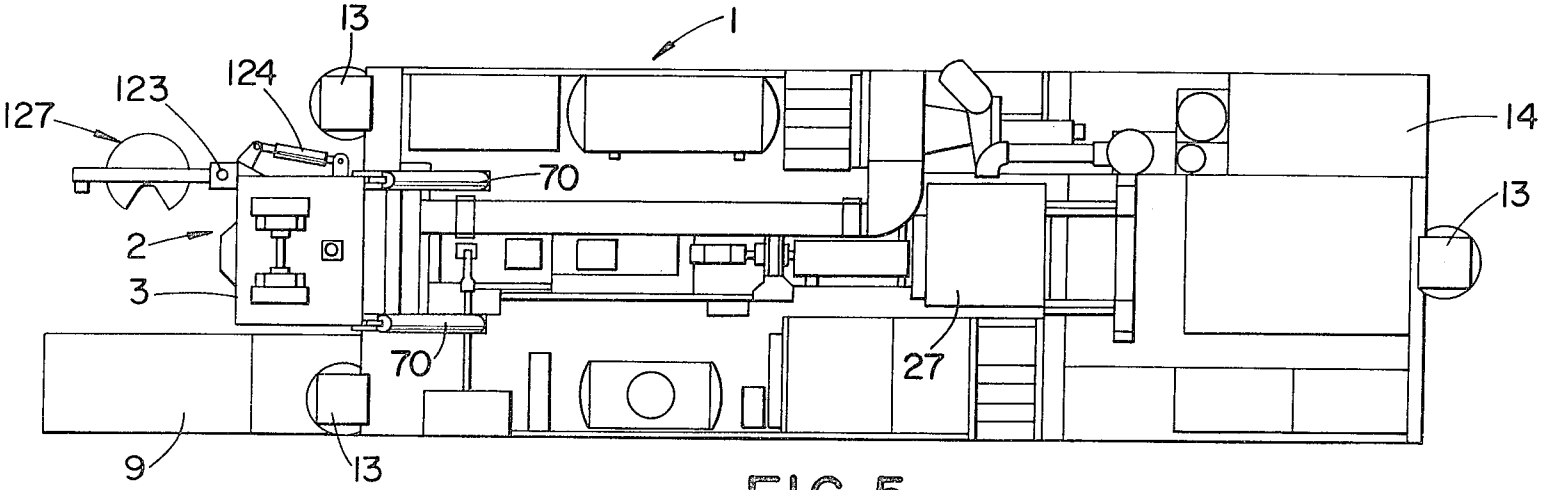
FIG. 5 is a plan of the apparatus of FIG. 1, to the scale of FIG. 3.
Figure 6:
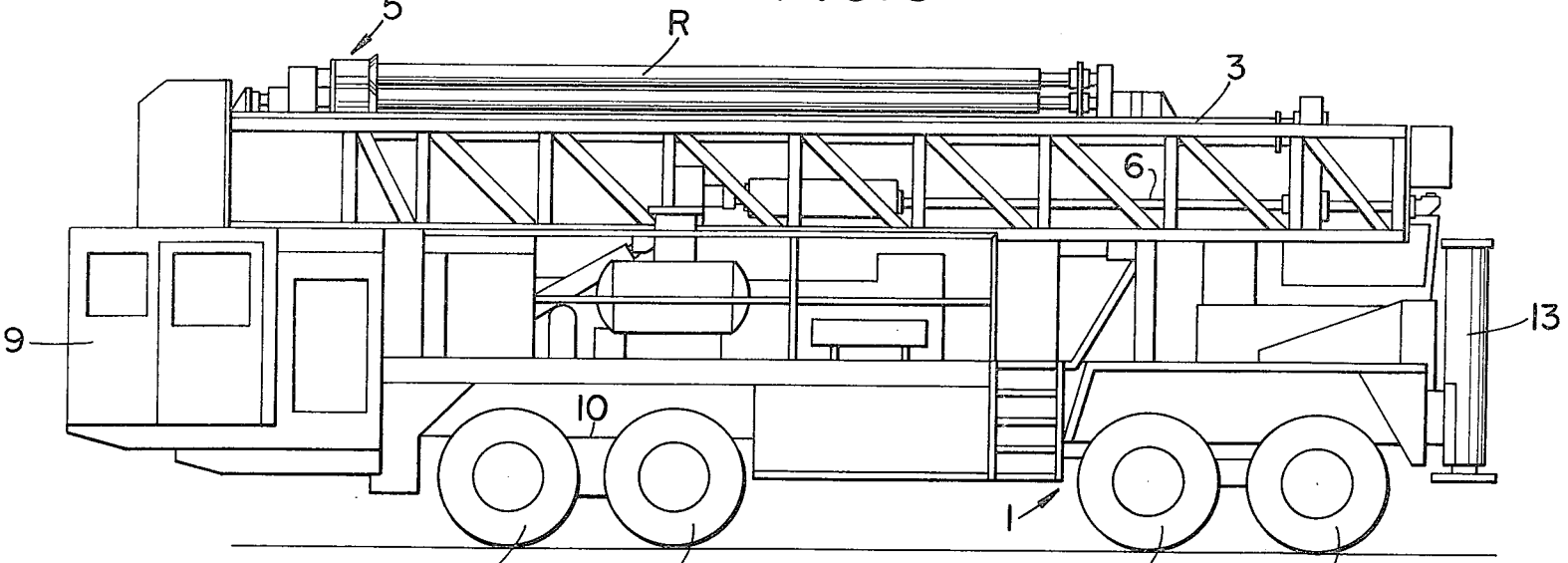
FIG. 6 is a view of the apparatus of FIG. 1, to the scale of FIGS. 2 and 3, showing the mast and the drill rod storage and handling rack generally horizontal for traveling.
Figure 7:
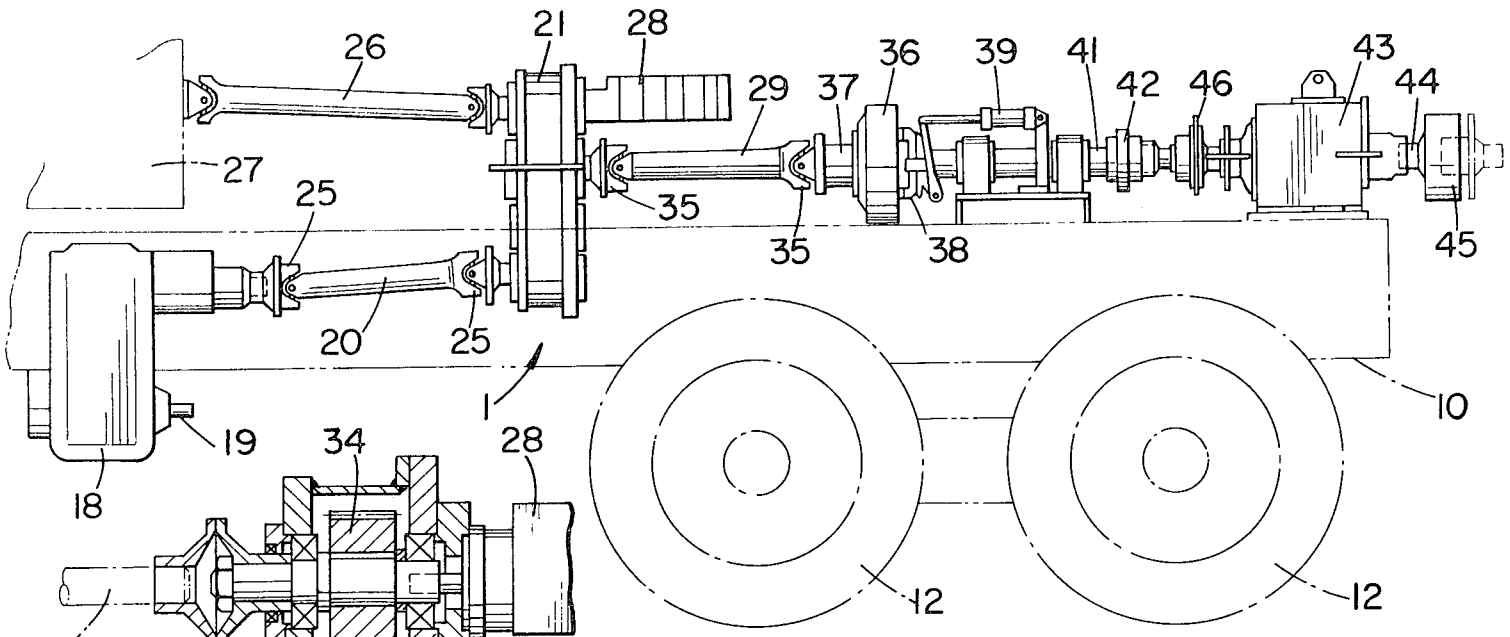
FIG. 7 is a side view to a larger scale showing means for driving various portions of the apparatus.
Figure 8:
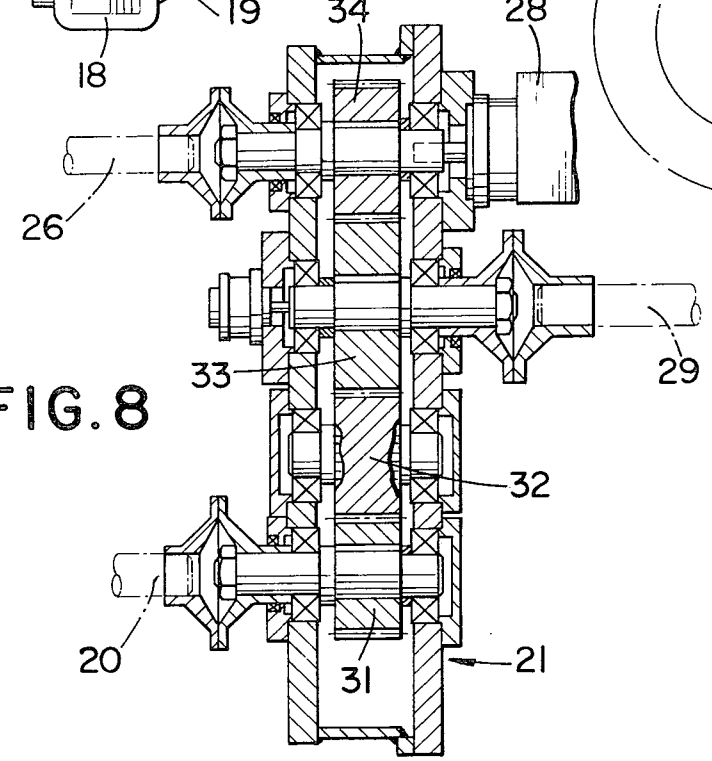
FIG. 8 is a section to a still larger scale of a power divider gear box included in the driving means.
Figure 13:
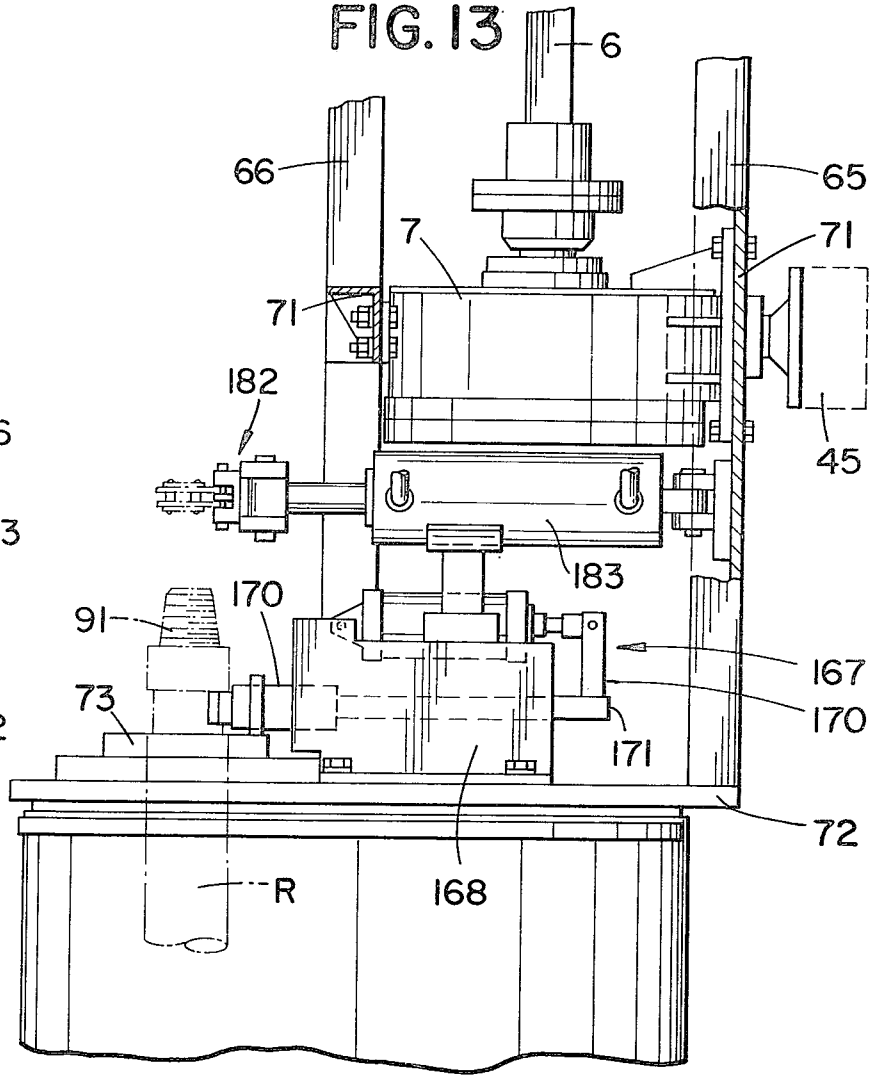
FIG. 13 is a side elevation, with parts broken away, of the lower portion of the mast showing, to a scale larger than FIG. 1, the means for driving the vertically movable drilling head, and means for facilitating loosening of threaded joints of drill rods.
Figure 14:
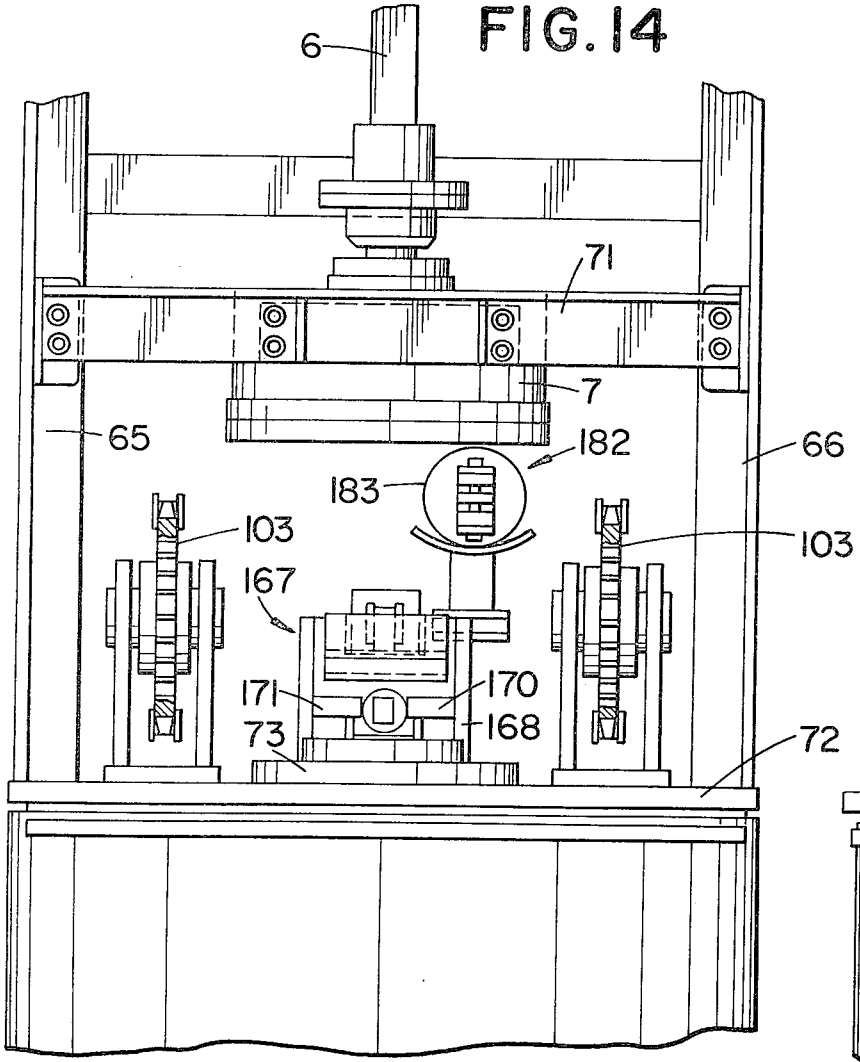
FIG. 14 is an elevation of the apparatus viewed from the left of FIG. 13.
Figure 15:
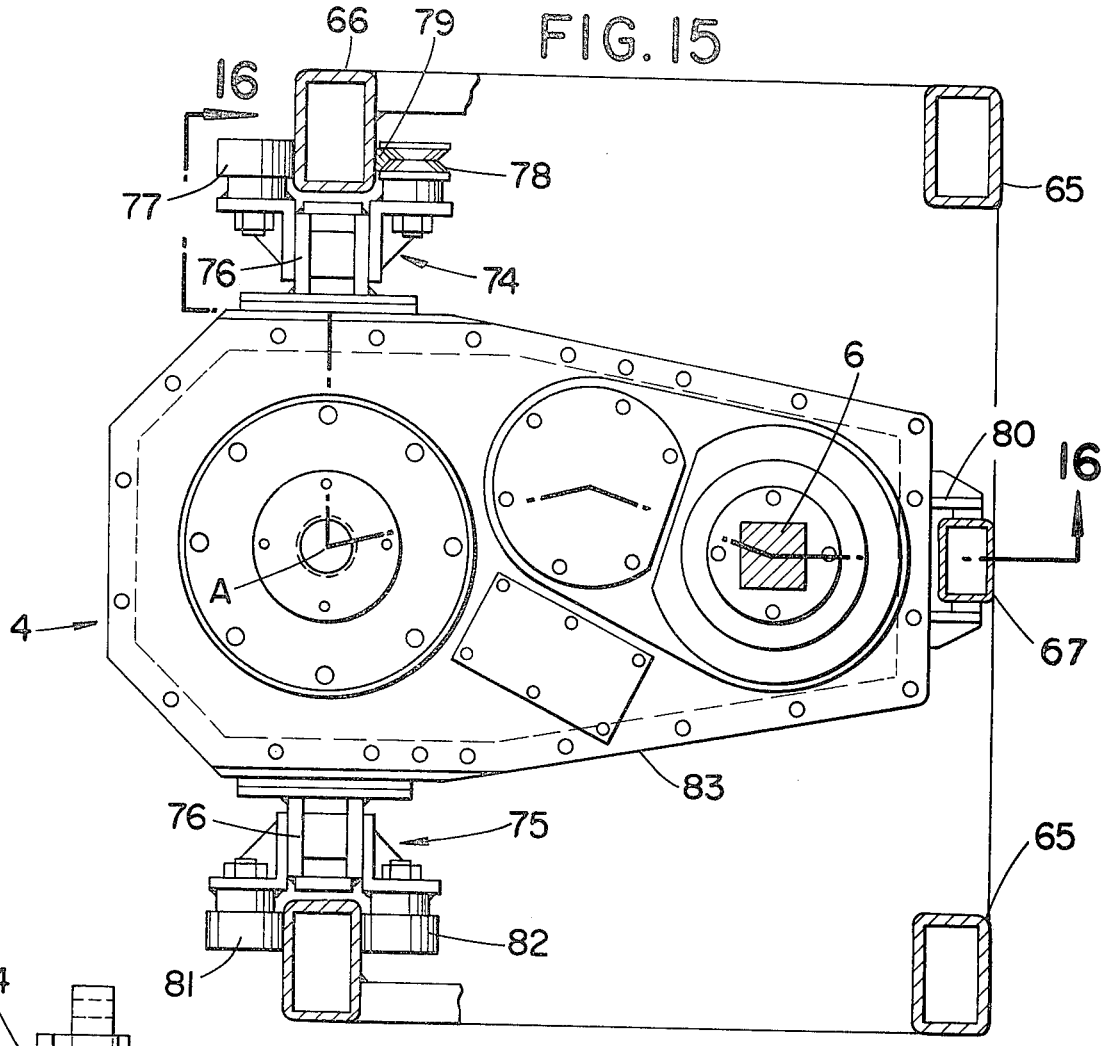
FIG. 15 is a plan view to an elarged scale of the drilling head and associated means for guiding it along the mast.

Drilling means 2 comprises a rigid mast 3 that is pivotally mounted on the rear end of vehicle 1 and adapted to be raised to an upright drilling position (FIGS. 1-5) and to be lowered to a horizontal traveling position (FIG. 6). Mast 3 carries a drilling head 4 mounted for movement in a guided path longitudinally of the mast and adapted when the mast is in its upright position to rotate, lower and raise along a drilling axis A, a drill string S made up of end-connected hollow drill rods R, the lowermost of which carries suitable cutter bit H (FIGS. 3-4).

Mast 3 also carries drill rod storage and handling apparatus 5 adapted to store a plurality of drill rods R, and, as required, to move them into alignment with the drilling axis to permit them to be individually connected to and disconnected from drilling head 4, and to store drill rods as required.

Drilling head 4 is rotated as required by a driving or kelly bar 6 mounted for rotation about a fixed axis B in the mast 3, head 4 being adapted to slidably but not rotatably engage such bar. Bar 6 is rotated from a gear box 7 rigidly fixed to the mast. Drilling means 2 also includes a known shroud 8 that is fixed to the bottom of the mast and adapted to extend to the ground around the bore hole to collect dust and dirt blown upwardly by air supplied under pressure through the interior of the strand of drill rods in a known manner. Drilling means 2 also includes, adjacent mast 3, a drilling control cab 9 from which an operator controls the drilling means and the drilling operation.

Mobile vehicle 1 comprises a rigid frame 10 adapted to be supported and transported in conventional manner, steerable front wheels 11 and rear driving wheels 12. The frame also carried hydraulically operated jacks 13, two at the sides of the rear end of the frame adjacent drilling means generally centrally of the front end of frame 10. The jacks are adapted to be extended downwardly as required to level the vehicle and stabilize it during the drilling operation (FIGS. 1-5) and be raised (FIG. 6) during travel of the vehicle.

The frame of the vehicle also carries at its rear end drilling control cab 9, and at its front end a driver control cab 14 and an internal combustion engine 15 of known type. The engine drives, through known shiftable transmission 16 controlled from cab 14, a drive shaft 17 that is connected to a known power divider gear box 18 adapted to be controlled from cab 14 to transmit power from engine 15 and shaft 17 to a drive shaft 19 for driving wheels 12 or to transmit power to a drive shaft 20 to a gear box 21.

Shafts 17, 19 and 20 have universal joints 23, 24, and 25. Gear box 21 is adapted to transmit power through shaft 26 to a known rotary air compressor unit 27 for supplying air under pressure to the interior of drill rods in the drill string, and to a known unit 28 for developing hydraulic fluid pressure for hydraulically operating parts of the drilling apparatus.

Gear box 21 (FIGS. 3, 8) also drives a shaft 29 from which driving bar 6 of the drilling means may be driven as required. Gear box 21 comprises a train of gears 31, 32, 33 and 34 by which shafts 26 and 29 are driven from shaft 20.

Shaft 29, having universal joints 35, is connected to a known clutch 36 having a driving member 37 and a driven member 38 actuated by fluid cylinder 39 controllable from cab 9. Clutch 36 is adapted when engaged to rotate a shaft 41 rotatably supported from frame 10 of the vehicle and connected by known torque-limiting coupling 42 to a reduction gear box 43 having output shaft 44 adapted to rotatably drive a disconnectible driving unit 45 described later. Shaft 41 rigidly carries a known disc brake element 46 (FIGS. 3, 7, 9, 10) adapted to be engaged by gripper 47 controlled from cab 9 and adapted to rapidly halt rotation of shafts 41 and 44 and parts driven by driving unit 45 to eliminate the inertial effects of the parts driven by clutch 36 and thereafter to hold these parts stationary.

Driving bar 6 of drilling means 2 (FIGS. 3, 13, 14, 15, 16) is connected and is driven from right angle drive gear box 7 having a driving stub shaft 48 driven from disconnectible driving unit 45 (FIGS. 3, 11, 12, 13, 14).

Unit 45 comprises a female driving member 51 mounted on output shaft 44 of gear box 43 and adapted to be engaged with and to drive a male driven member 52 fixed to stub shaft 48 of gear box 7 mounted on mast 3. Member 51 (FIGS. 11, 12) comprises a housing 53 fixed to a flange 54 4igidly mounted on shaft 44. An annular stop member 55 is clamped to the front of housing 53 by bolts 56. An axially movable driving element 57 is slidably mounted on bolts 56 and biased by springs 58 toward stop member 55 which limits travel of element 57. Element 57 has a polygonal-shaped opening 59 therethrough, the eight-cornered generally star-shaped opening illustrated being found preferable. The opening has beveled front edges 60.

Male driven member 52 on shaft 48 has a projecting portion 62 having an axially extending exterior contour 63 that is identical with but slightly smaller than that of opening 59 and that has a beveled edge 64 at its free end. Consequently as mast 3 is raised to its upright position, portion 62 of driven member 52 engages movable driving element 57 of driving member 51. If it should happen that the polygonal contours of opening 59 and portion 62 are in identical relative angular positions, portion 62 will enter opening 59. However, if they are not in identical angular positions, as will usually be the case, the free end of portion 62 of driven member 52 and the outer surface of element 57 of driving member 51 will contact as shown in the upper portion of FIG. 11 and the driving element 57 will move axially inwardly of housing 53 of the driving member 51 as the axis of driven member 52 aligns with that of driving member 51 as the mast 3 moves to its final upright position. Then, as member 52 rotates when power is supplied and clutch 36 is engaged, portion 62 of driven member 52 will snap into polygonal opening 59 of driving member 51 to provide positive driving engagement between the driving and driven members, and hence positive rotation of driving bar 6 (FIGS. 11-16), the beveled edges of portion 62 and opening 59 facilitating entry of portion 62 into opening 59.

As shown in FIGS. 1-6, 13 and 14, the mast 3 is a rigid structure comprising longitudinal members 65 at the rear of the mast, longitudinal members 66 at the front of the mast, rear member 67, and bracing members 68, all rigidly connected together. The mast is connected by a pair of pivot structures 69 to the rigid vehicle frame 10 and is adapted to be raised to its upright position (FIGS. 1-5) and lowered to its traveling position (FIG. 6) by means of a pair of fluid powered cylinders 70. The mast includes cross members 71 to which gear box 7 is rigidly connected, and a bottom plate, 72 which carries guide 73 for the drill rods in the drill string as it drills into the earth; plate 72 also carries dirt shroud 8 and other mechanism to be described later for loosening drill rods.

The front members 66 of the mast and rear member 67 rigidly fixed in the mast centrally between and parallel to rear members 65 (FIGS. 1, 2, 4, 15, 16) act as guide members to support and guide drilling head 4 for movement in an upright path along the mast when the mast is upright. Drilling head 4 carries front guide means 74 and 75 (FIGS. 15, 16) that move along front frame members 66. Guide means 74 comprises bracket structure 76 that is fixed to one side of head 4 to extend laterally and longitudinally of the head. This bracket carries two longitudinally spaced rollers 77 that are rotatable about axes normal to the path of movement of the head 4 and that contact one side of associated member 66; this bracket also carries two other longitudinally spaced freely rotatable rollers 78 each having a V-shaped peripheral groove that engages the outer V-cross sectioned surface of a guide strip 79 on the other side of such member 66 to guide head 4 laterally relative to the member 66. Drilling head 4 also carries a rear guide member 80 that slidably engages both sides of rear guide member 73 to prevent lateral movement of the rear end of head 4.

The other guide means 75 comprises another bracket structure 76 fixed to the other side of head 4 and carrying pairs of longitudinally spaced freely rotatable rollers 81 and 82 engaging opposite sides of the other member 66. Therefore, drilling head 4 is accurately guided for movement in a fixed path relative to members 66 of the mast.

Figure 16:
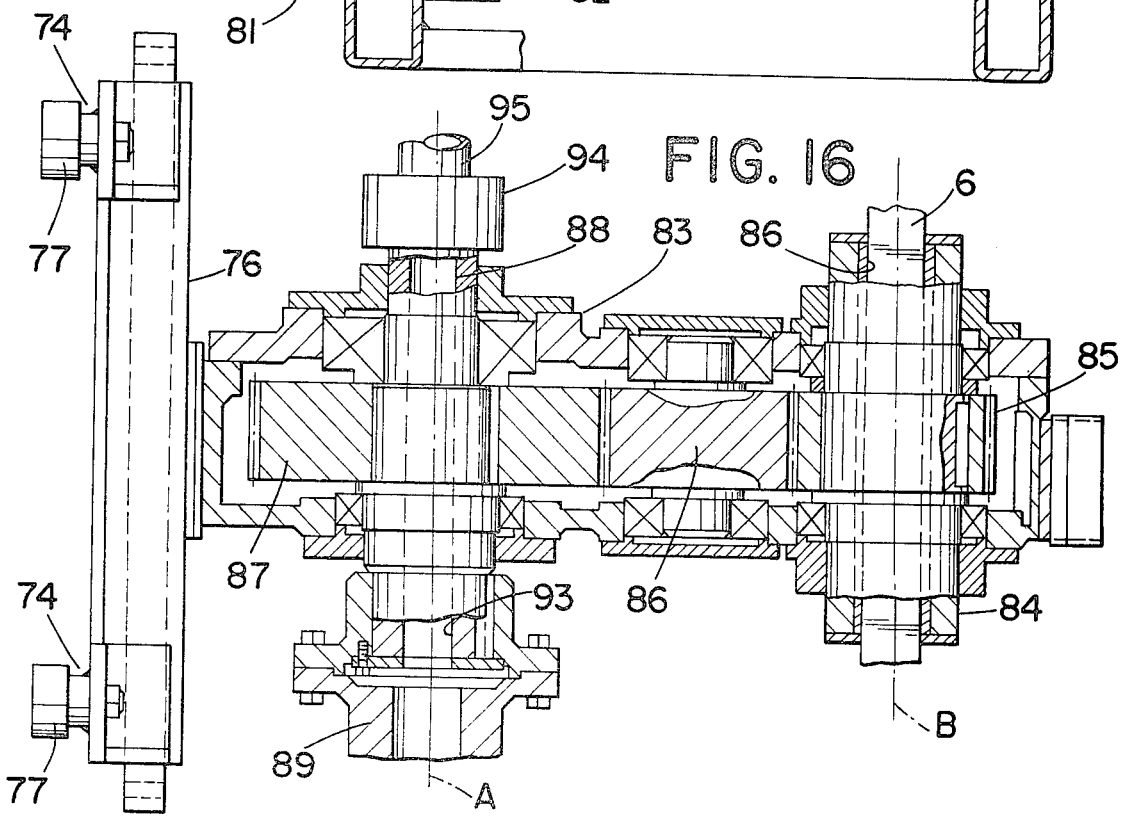
FIG. 16 is a sectional elevational view along line 16—16 of FIG. 15, to the same scale.
Figure 17:
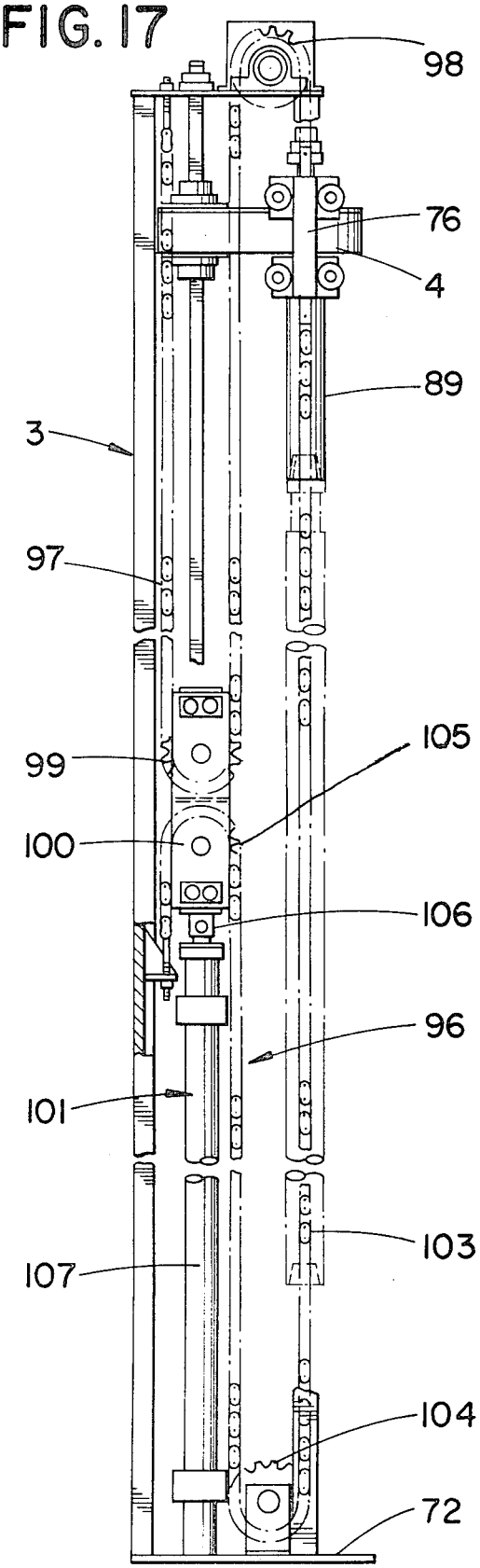
FIG. 17 is a side elevation to a scale larger than FIG. 3 of mechanism for moving the drilling head along the mast.
Figure 18:
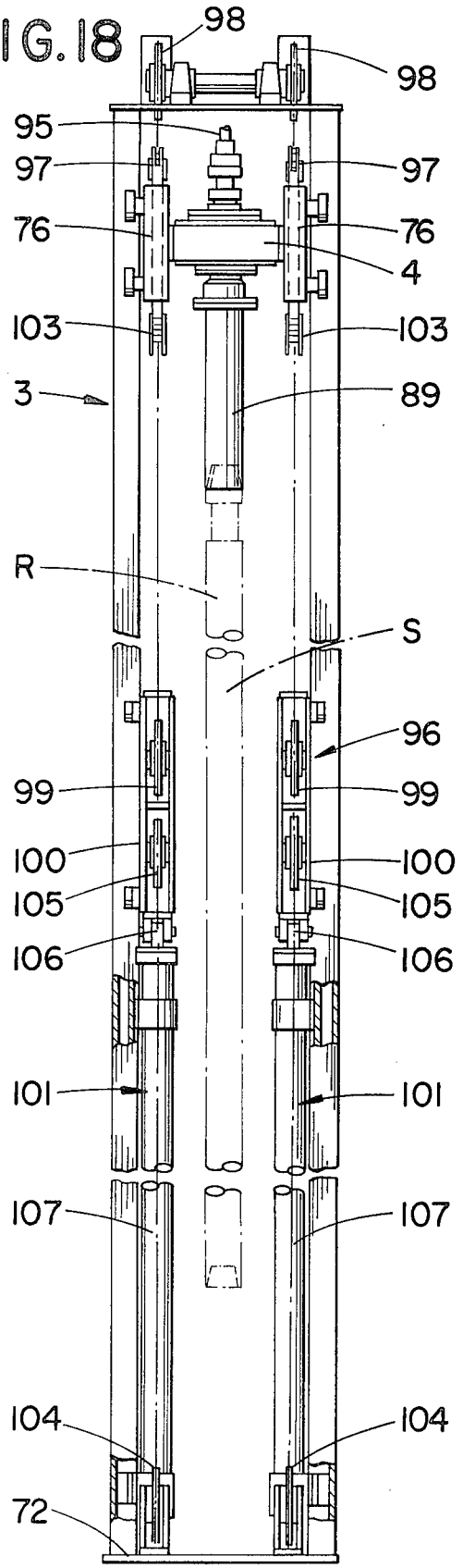
FIG. 18 is a view, partly broken away, of the mechanism from the left of FIG. 17.
Figure 20:
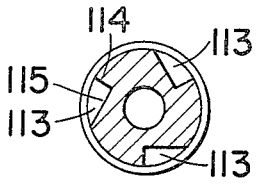
FIG. 20 is a section along line 20—20 of FIG. 19, to the same scale.

Drilling head 4 (FIGS. 1-4, 16, 17) comprises a rigid housing 83 to which brackets 76 are fixed. A sleeve 84 is mounted in the housing for rotation about an axis B parallel to the drilling axis A. The sleeve has a through opening 86 of polygonal cross section, square in the illustrated embodiment, that matches the cross section of the driving bar 6 but permits the head 4 to move slidably along the bar. Inside housing 83, sleeve 84 rigidly carries a gear 85 engaging idler gear 86 that engages a gear 87 rigidly mounted on a spindle 88 rotatably mounted in housing 83 (FIG. 16). An adapter spindle member 89 (FIGS. 1-4, 16-19) is bolted to spindle 88 and has at its lower end an internal tapered thread 90 adapted to engage a mating external tapered thread 91 on the upper end of associated drill rod R. Spindle 88, member 89 and the drill rods have connected longitudinal openings therethrough. The upper end of opening 93 in spindle 88 is connected to a suitable known fitting 94 to an air hose 95 (FIGS. 3, 16) connected to compressor 27 to supply air under pressure to the interiors of spindle 88, member 89 and drill rods connected to member 89 to blow out drilled material from drilled bore D in the earth.

Therefore, as driving bar 6 is rotated it positively rotates spindle 88 and any drill rods connected to member 89 fixed to the spindle, and drilling head 4 can move longitudinally of the mast while its spindle and attached drill rods are being so rotated.

Crowd mechanism 96 (FIGS. 17, 18) moves drilling head 4 downwardly to urge the drill rods in the drill string into the earth during the drilling operation, and upwardly to permit removal of the drill rods as required. At each side of mast 3, one end of a chain 97 fixed to the top of one of the brackets 76 at the sides of drilling head 4 and when the mast is in its upright position passes upwardly over a sprocket 98 and then downwardly and under another sprocket 99 fixed to a movable bracket 100 of actuating mechanism 101, the other end of the chain being fixed to the top of the mast. Also at each side of the drilling head, another chain 103 is fixed at one end to the bottom of the bracket 76 on drilling head 4 and passes downwardly under a sprocket 104 at the bottom of the mast, then upwardly over another sprocket 105 fixed to bracket 100, and has its other end fixed to the mast.

The actuating mechanism 101 at each side of the drilling head comprises the bracket 100, carrying sprockets 99, 105, fixed to the piston rod 106 of fluid actuated long travel cylinder 107 that provides a travel of the rod of essentially half the distance through which the drilling head moves. Sprockets 98 at the top of the mast are rigidly connected to a common drive shaft so that their rotary motion is coordinated; sprockets 104 are individually rotatable.

It is obvious that when piston rods 106 are extended from their cylinders 107, drilling head 4 is pulled down and causes the string S drill rod R connected to head 4 to penetrate the earth. When the piston rods are retracted into their cylinders head 4 is lifted and withdraws the drill rods from the drilled bore D.

Each of the drill rods R (FIGS. 19-22) handled by the drill rod handling means 5 comprises an elongated tubular body 108 the upper end of which has an external tapered right hand thread 91 of known configuration in this art and adapted to engage a mating internal thread of a connected drill rod or of coupling member 89 connected to drilling head 4; the lower end of body 108 has an internal tapered right hand thread 90 adapted to engage the external thread 91 of a connected drill rod or of cutter head H.

When the rod is in upright drilling position, body 108 has an external cylindrical portion 109 extending a substantial distance below upper thread 91 and having an external cylindrical portion 111 of reduced diameter located a short distance below upper thread 91 with an upper radial shoulder 112 between portions 109 and 111, reduced portion 111 containing a plurality, three in the illustrated embodiment, of axially extending equiangularly spaced elongated slots 113. Each slot 113 in cross section (FIG. 20) has a radial wall 114 and an intersecting wall 115 located at a right angle to wall 114, slots 113 being arranged so that when one of the walls 114 is engaged by a stop member rotation of the rod in a counterclockwise direction is prevented, thus permitting unscrewing upper thread 91 of a connected member such as a drill rod or member 89.

Body 108 has another external cylindrical reduced portion 116 near the upper end of the rod but a substantial distance below reduced portion 112, portion 116 being located immediately below larger cylindrical portion 109, radial shoulder 117 at the upper end of portion 116 separates portions 109 and 116. A plurality of axially extending equiangularly spaced longitudinal slots 118, three in the illustrated embodiment, are located at the lower portion of the rod at locations where they do not intersect internal thread 90. Each of these slots (FIGS. 19, 21, 22) has a rectangular cross section, axially extending sides 119 parallel to a radius of the rod, and a bottom 120 that is flat for a major portion of the slot length but having curved ends 121 extending from the flat bottom to the surface of the rod.

The rod also has an axial opening 122 extending longitudinally through the entire length of the rod from one end to the other to permit pressurized air to be fed through the rod to the bit H as described above. The rod is so designed that when it is connected to an adjacent rod or member 89 of the drilling head 4, a closed air-tight passage extends throughout the resulting drill string from drilling head 4 out through bit H.

The drill rod storage and handling means 5 of the illustrated apparatus comprises (FIGS. 1, 2, 23, 24, 26-30) a shaft 123 rotatably mounted on mast 3 about an axis X parallel to the axis A of spindle 88 that is also the drilling axis and adapted to be moved to and between two positions by fluid cylinder 124 connected between the shaft and the mast. Shaft 123 carries upper and lower laterally extending arms 125 and 126 that support a rack 127 for rotation about an axis Y parallel to axis X. Rack 127 is adapted to hold and carry several drill rods R and laterally move them so their axes can individually coincide with the drilling axis A as required. Rack 127 comprises a shaft 128 rotatably supported about axis Y from arms 125, 126.

The lower portion of the rack includes transverse lower supporting member 129 (FIGS. 23, 24, 26–30) fixed to shaft 128 and carrying socket means taking the form of a plurality of upwardly open cup members 130 each having a flared upper edge and adapted to receive and hold the lower end of a drill rod. In the illustrated embodiment, member 129 has four cup members 130 and also an opening 131 with a circular arcuate rear portion 132. The centers of the cup members and portion 132 are equiangularly spaced from and about axis Y. Opening 131 also has a side wall 133 extending essentially radially of axis Y, and a side wall 134 extending generally parallel to wall 133.

Each cup member 130 has, between its open upper end and its closed lower end, a radially extending rectangular cross sectioned housing 135 that slidably carries a latch member 136 that has a mating cross section and hence is non-rotatable. Member 136 thus is movable in a straight path between an extended position in which the inner end of member 136 projects substantially into the cup member and a retracted position in which the inner end does not so project into member 136, is biased by spring 137 inwardly toward the cup member interior such inward movement being limited by stop 138 engaging the outer closed end of housing 135. The inner end of member 136 has a side surface 139 parallel to the radial axis of member 136 and the axis of the cup member 130, a side surface 140 parallel to the axis of the cup member and inclined toward the end of member 136, and an inclined top surface 141 that can be engaged by the bottom of a drill rod to force member 136 outwardly to permit the lower end of the drill rod to be fully inserted into the cup member. After such insertion, the inclined side surface 140 causes the latch member to retract and ratchet to permit rotation of the drill rod in a clockwise direction in the cup member, but the radial side surface 139 prevents rotation in a counterclockwise direction by contact of such surface with a side surface 119 of a slot 118 in the lower end portion of the drill rod when the latch member is extended.

Rack 127 also has an upper laterally extending rigid supporting member 142 (FIGS. 23, 28, 29) that is rigidly fixed to the upper portion of shaft 128, and that laterally supports the upper portions of drill rods in the rack and permits their removal from the rack. Member 142 has four identical generally radially extending outwardly opening slots 143 and a single generally radially extending outwardly open slot 144 of different and wider configuration. Slots 142 and 143 have inner circular arc portions the centers of which are equidistantly and equiangularly spaced about axis Y of the rack 127. Each of slots 143 has an inner portion 145 that is an arc of a circle greater than a semi-circle and of a diameter slightly larger than the maximum diameter of the cylindrical portion of the drill rod body 108 of rod R between reduced portions 111 and 116, and a neck portion 146 extending from circular portion 145 to the periphery of member 142 and of a width slightly larger than the diameter of reduced portion 116 of rod R but substantially smaller than the diameter of the larger rod portion 109 between reduced portions 111 and 116. Radially extending slot 144 has an inner portion 147 of semicircular configuration and of preferably slightly larger radius than portions 145 of slots 143 and a neck portion formed by straight side walls 148 and 149 that extend outwardly from circular portion 142 to the periphery of member 142 and essentially parallel to the radius of member 142 between axis Y and the center of circular arc portion 147. The centers of circular portions 145 and 147 of slots 143 and 144 are equidistantly and equiangularly spaced from and around axis Y. Moreover, the centers of circular portions 145 of slots 143 of upper member 142 are aligned in rack 127 with the centers of the circular cross sections of cup members 130 of lower supporting member 129 of the rack, the center of circular portion 147 of slot 144 in member 142 is aligned with the center of the circular portion of slot 131 in member 129, and the sizes and alignment of slots 131 and 144 are identical, as is apparent from FIG. 29.

The means for rotating rack 127 about its axis Y comprises (FIGS. 23–25, 30) a geneva wheel mechanism 150 comprising a geneva start wheel member 151 fixed to the lower end of shaft 128 above arm 126. Member 151 has a number of radially extending outwardly open slots 152 equal in number to the number of cup members 130 of member 129 and to the number of slots 143 of member 142. Member 151 also has intermediate curved peripheral portions 153 and 154. Portions 153 constitute arcs of a circle and are shaped to fit the exterior circular arc portion 155 of the periphery of a rotatable actuating member 156 having actuating arm 157; portion 155 constitutes the major part of a circle. Curved portion 154 has a radius slightly larger than that of curved portions 132 of slots 131 and 144 of members 129 and 142. Slots 152 are all identical and equidistantly spaced from axis Y of the storage rack. Each slot 152 is symmetrical around a radius extending laterally from axis Y and these radii of slots 152 and the radius on which lies the center of circular arc portion 154 are equiangularly spaced from each other. Arcuate peripheral portions 153 of member 152 are identical and equidistantly spaced from the axis X and equiangularly spaced between end slots 152.

Figure 29:
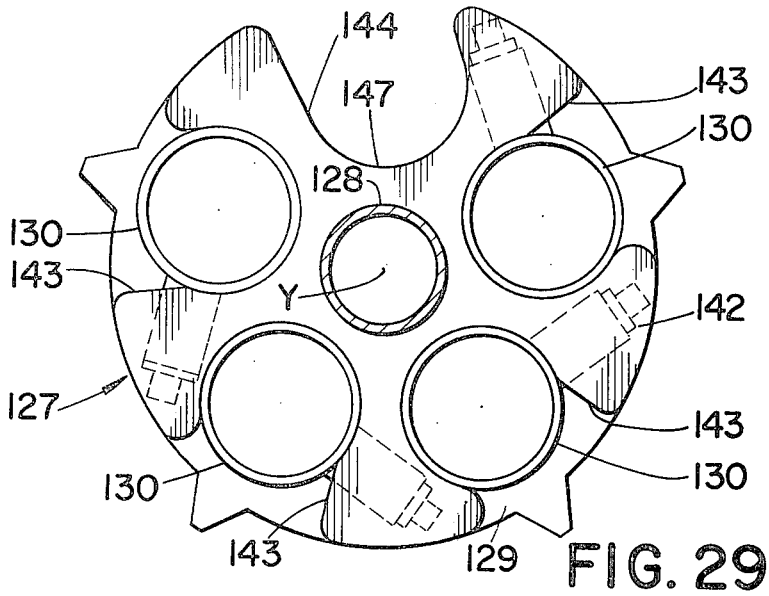
FIG. 29 is a view from line 29—29 of FIG. 23, showing the relationship of the upper and lower drill rod holding portions of the rack.
Figure 19:
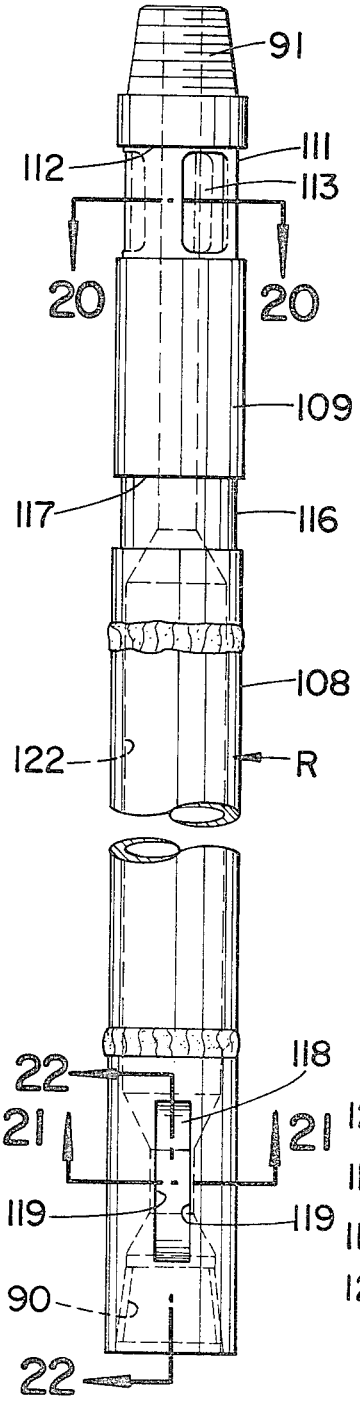
FIG. 19 is a side view, to a scale larger than any heretofore used of a drill rod embodying the invention that can be advantageously used in the illustrated apparatus.
Figure 22:
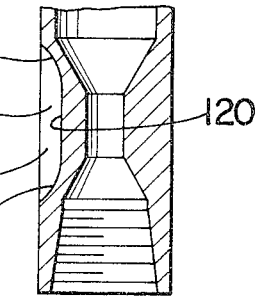
FIG. 22 is a vertical section along line 22—22 of the lower end of the drill rod of FIG. 19, to the same scale.
Figure 21:
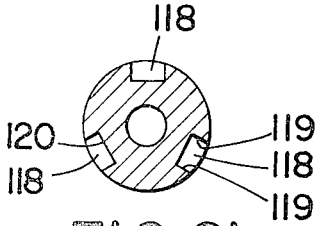
FIG. 21 is a section along line 21—21 of FIG. 19, to the same scale.
Figure 30:
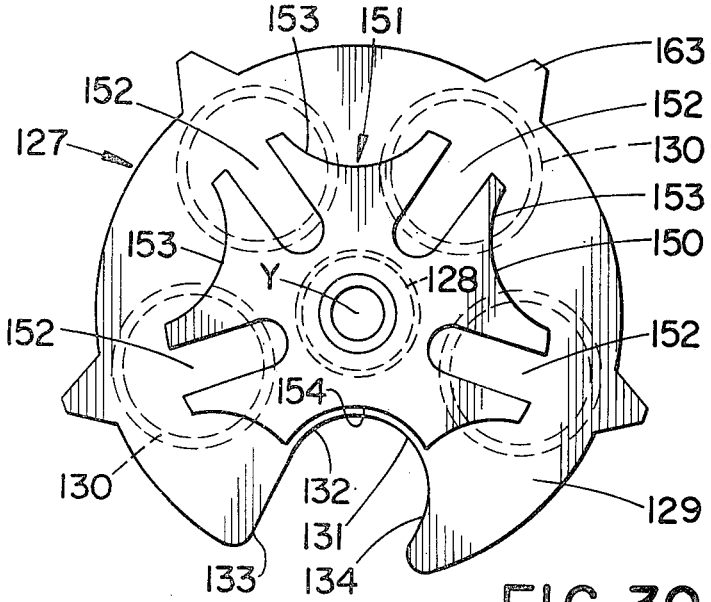
FIG. 30 is a bottom plan view of the lower rod holding portion of the rack, and a portion of the means for rotating the rack to predetermined positions.
Figure 23:
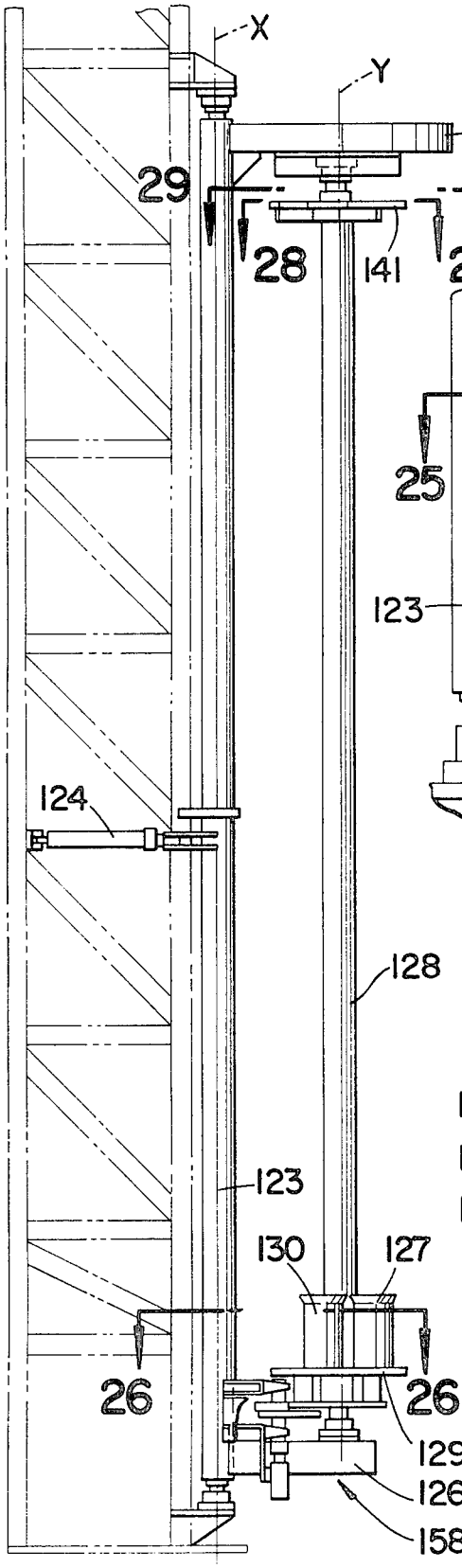
FIG. 23 is a side view of the drill rod storage and handling apparatus, no drill rods being shown in this view for the sake of clarity.
Figure 24:
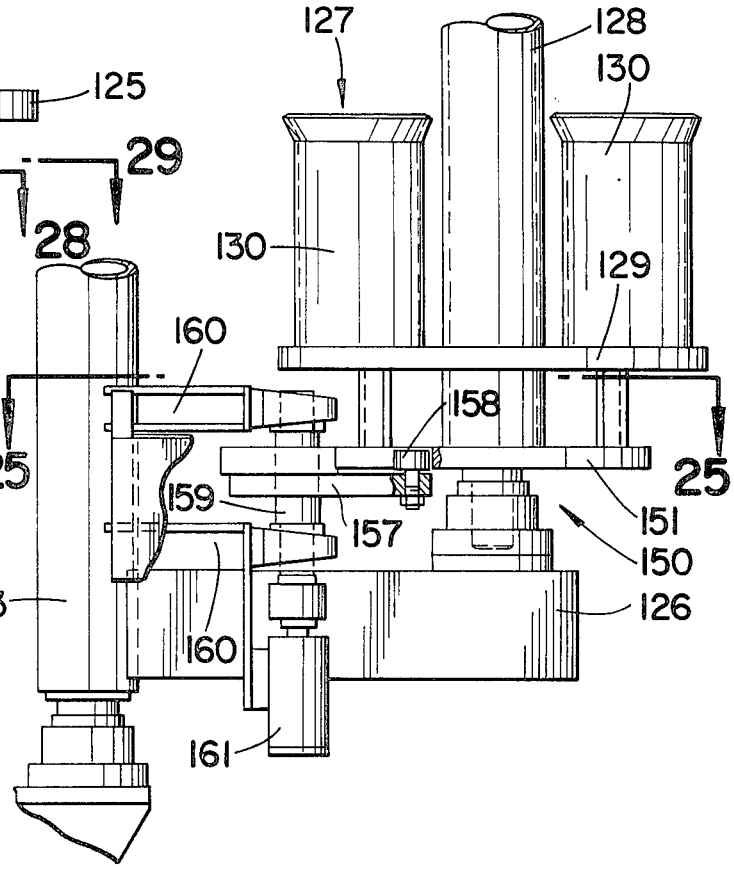
FIG. 24 is a side view of the lower portion of the apparatus of FIG. 23, to a larger scale.

The relationship of the locations of slots 152 and curved portions 153 of geneva wheel member 151 to the cup members 130 of lower supporting member 129 of the rack 127 and to the slots 141 of upper supporting member 141 of the rack are shown in FIGS. 29 and 30. It is apparent that the radial axes of slots 152 are aligned with those on which lie the centers of cup members 130 of member 129 and the centers of curved slot portions 147 of member 141, and that the centers of the curved portion 132 of slot 131 of member 129 and curved portion 147 of slot 144 of rack member 142 are aligned with the center of curved portion 152 of geneva wheel member 151.

Figure 25:
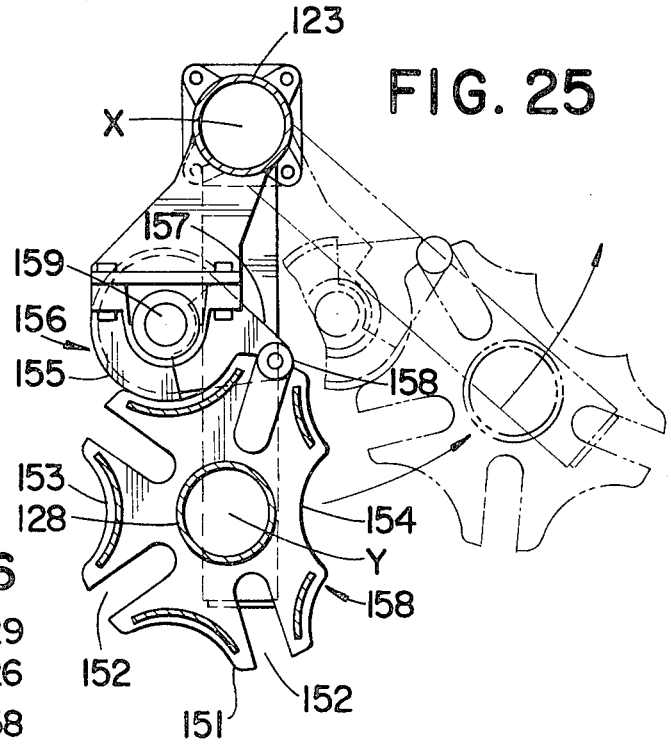
FIG. 25 is a section along line 25—25 of FIG. 24 and to the same scale.
Figure 28:
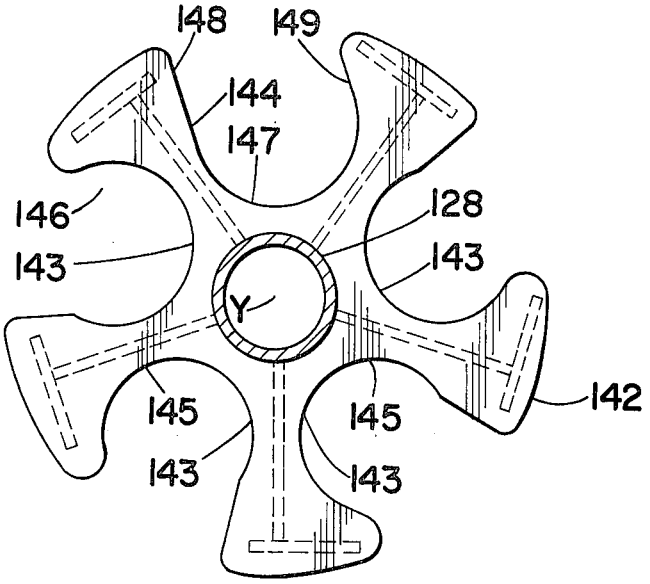
FIG. 28 is a plan view along line 28—28 of FIG. 23 to the scale of FIG. 26, of the upper portion of the rack, for holding the drill rods at the upper end of the rack.
Figure 26:
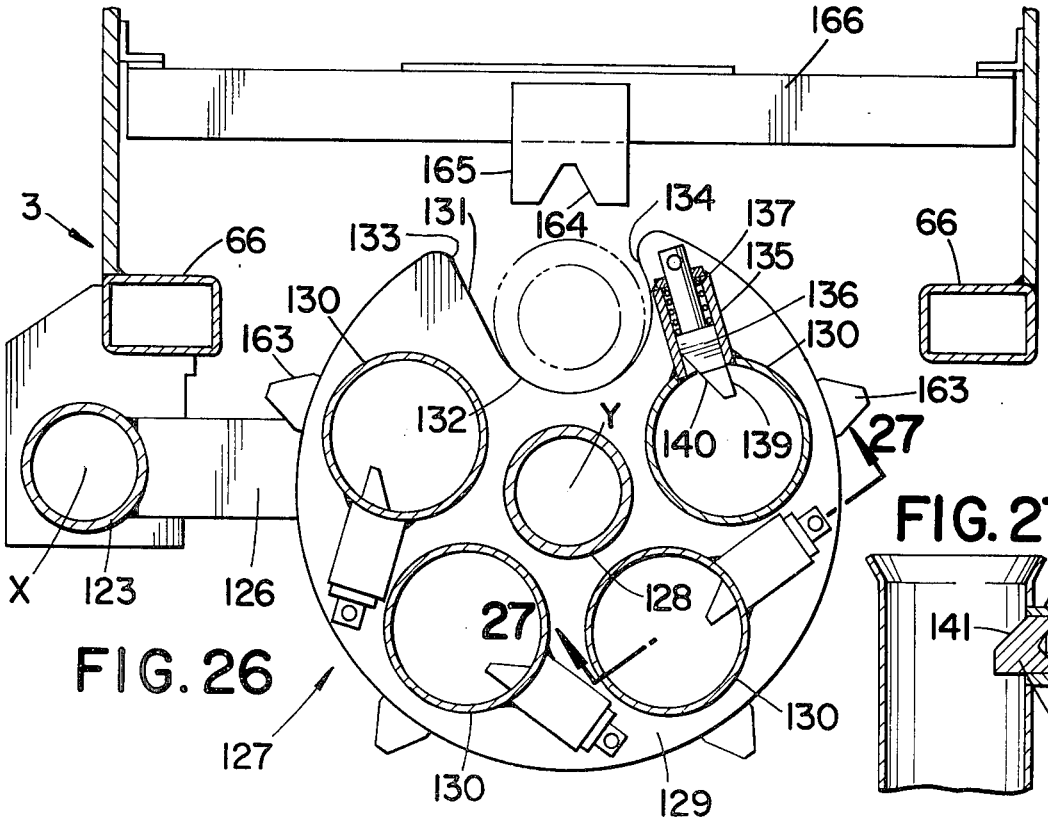
FIG. 26 is a plan view along line 26—26 of FIG. 23 of the lower portion of the rotatable drill rod storage rack, for holding the drill rods at the lower end of the rack, the scale being larger than that of FIG. 24.
Figure 27:
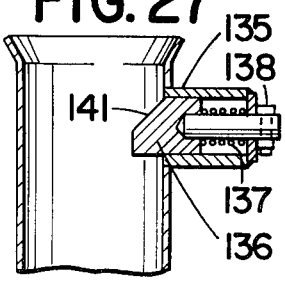
FIG. 27 is a vertical sectional view along line 27—27 of FIG. 26 and to the same scale.

Arm 157 of actuating member 156 carries a roller 158 adapted to be engaged in the slots 152 of geneva wheel member 150 (FIG. 25). Actuating member 156 is fixed to, and positively rotated as required by, shaft 159 rotatably supported by arms 160 rigidly connected to supporting shaft 123 of rack 127. Shaft 159, and hence actuating member 156, is rotated as required by a fluid powered motor 161 supplied as required with fluid under pressure by unit 28 through known conduit means not shown and controlled from drilling control cab 9. By suitable actuation by motor 161, the geneva wheel mechanism can turn the rack about axis Y to individually bring each cup member 130 of lower supporting member 129 and its associated aligned slot 142 of upper supporting member 141 to a position where the axis of a drill rod in such cup and slot, which is essentially the axis along which the cup member and slot are aligned, is aligned with the drilling axis A, after the rack has thereafter been bodily moved about axis X. The action of the geneva wheel mechanism is such that it rotates rack 127 about its axis Y to exactly the proper location for this purpose, by interaction of arm 157 and of its roller 158 of actuating member 156 in the appropriate slot 152 of the geneva wheel member 151 and by interaction of the exterior circular arc portion 155 of the actuating member with the appropriate arcuate peripheral circular arc portion 153 of the geneva wheel member to halt rotation of the rack at the proper angular location about axis Y. Despite the large sizes and weights of drill rods in the rack and the resulting large inertial forces caused by the weights of such drill rods and of the rack, the geneva wheel mechanism positively starts movement of the rack about axis Y, positively moves the rack about such axis, and accurately and positively halts movement of the rack as required for proper positioning of the selected aligned cup member 13 and slot 142.

Means is also provided to hold the rack 127 in the proper position after the rack has been rotated about its axis Y and after the rack has thereafter been bodily moved about axis X on the mast, to cause a selected cup member 130 and its aligned slot 142 to have their common axis aligned with drilling axis A as described above. Such holding means includes radially extending projections 163 on the periphery of lower supporting member 129 of the rack (FIGS. 26, 29, 30) located so each of such projections is adapted to mate with a mating notch 164 on a lug 165 fixed to a frame member 166 at the lower end of the mast, after the rack is properly located, to hold the rack in its proper position and thus to hold the selected rod in proper position.

The illustrated apparatus also includes (FIGS. 13, 14, 31, 32) wrench means 167 for loosening a threaded joint between a lower drill rod and an upper element threaded onto the upper end of the drill rod, such as another drill rod or spindle member 89 connected to the drilling head 4, and for supporting the lower drill rod after it is disconnected from the upper element. Wrench means 167 (FIGS. 31, 32) comprises a base member 168 fixed to the bottom plate 72 of the mast, and a movable drill rod-engaging member 170 comprising a plate 171 slidably supported on member 168 and adapted to be moved toward and away from the drilling axis A and the drill rod centered on the axis, by a fluid powered cylinder 172 connected to member 168 and having a piston rod 173 connected to plate 171. Plate 171 has at its front end a concave recess 174 of curved configuration adapted to engage the reduced portion 111 near the upper end of a drill rod in the ground, so that the upper surface of edge of opening 174 plate 171 can engage the shoulder 112 at reduced portion 111 to support the drill rod during and after the loosening operation.

Member 170 also includes a latch member 175 that is mounted on and reciprocable relative to plate 171 in a path transverse to drilling axis A, being slidably but nonrotatably supported in a housing 176 of rectangular cross section that is fixed to plate 171 and matches the cross section of member 175. Latch member 175 is fixed to a rod 177 that extends through the rear wall 178 of housing 176 and has near its free end a stop member 179 that by engagement with wall 178 limits outward movement of the latch member. The latch member is biased toward the drilling axis by compression spring 180. Latch member 175 has a flat side surface 181 adapted when the member is extended to engage the radial wall 114 of a notch 113 in reduced portion 111 of the lower drill rod and prevent rotation of the rod when it is urged to rotate in an unscrewing direction which is counterclockwise in the illustrated embodiment. The latch member also has an inclined side surface 182 that can contact the intersecting inclined side walls 115 of the notches 113 in the drill rod and be forced to retract to permit rotation of the rod in the opposite direction which is clockwise in the illustrated apparatus.

Consequently, when it is desired to loosen and disconnect the threaded joint between a lower drill rod and an upper element such as an upper drill rod or spindle member 89 of drilling head 4, the lower drill rod is lifted by raising the drilling head until such drill rod is in the position shown in FIG. 32, so that shoulder 112 of reduced portion 111 of the lower rod R is slightly above the tops of drill rod engaging plate 171 and latch member 175. Fluid cylinder 172 is then actuated to move plate 171 so its recess 174 contacts the side of reduced portion 111 of the rod under shoulder 112, thereby causing latch member 175 to engage portion 111 of the drill rod, usually on the curved surface of portion 111, so the latch member is pushed back against the spring 180. The upper element and lower drill rod are then rotated by the drill head 4 in the unthreading direction, or counterclockwise in the illustrated case; latch member 175 is forced outwardly by spring 180 to enter one of the slots 113 of the lower drill rod and engage radial wall 114 of such slot, to prevent further rotation of the rod in such direction. Then, after the threaded joint between the lower drill rod and the upper element is loosened and rotation of the upper element is continued, the lower drill rod is held against rotation so that the upper element is unscrewed from the lower drill rod. The lower drill rod and any drill rods connected to it below it are then supported by plate 171 engaging shoulder 112 of the rod, so that the lower drill rod thus is located where it can be engaged and screwed onto the spindle member 89 of the drilling head 4 so such drill rod can be raised and disconnected in a like manner from a still lower drill rod and removed by rack 127 from the drilling axis, or where it can have another drill rod connected to its upper end, as described later.

For those situations in which it is desired to disconnect an upper drill rod from a lower drill rod and the threaded joint between these rods is so tight that the drilling head 4 cannot loosen such threaded joint because the threaded joint between the upper rod and the spindle member 89 would loosen first, the auxiliary loosening means 182 (FIGS. 13, 14, 33, 34) is provided.

Figure 33:
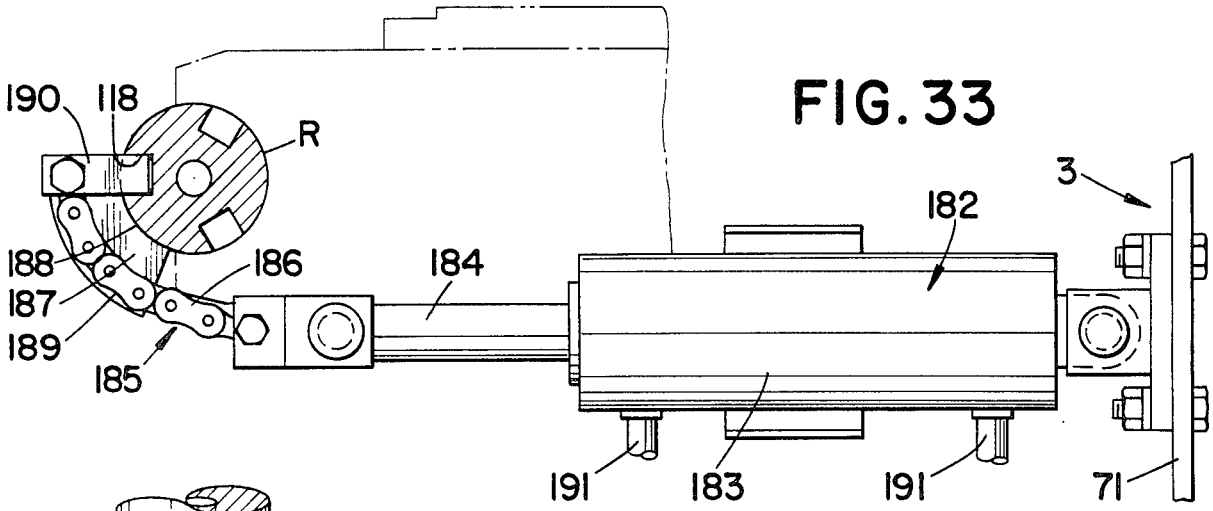
FIG. 33 is a plan view of breakout means turning a drill rod to loosen a threaded connection of the drill rod to an adjacent element, the scale being smaller than that of FIGS. 31 and 32.
Figure 34:
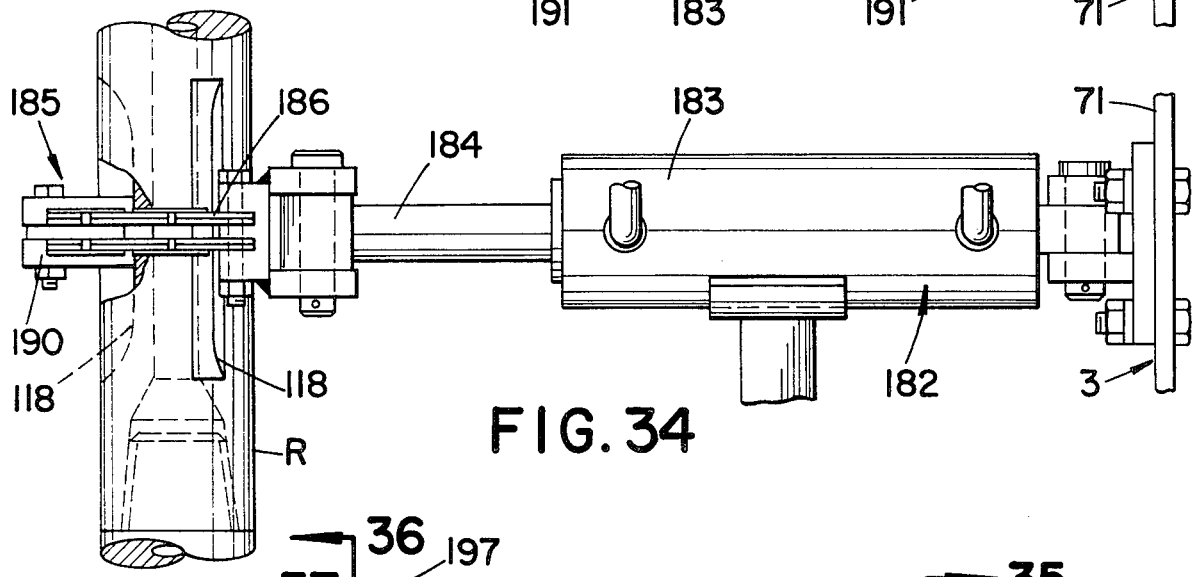
FIG. 34 is a side elevation of FIG. 33 apparatus.

Means 182 is mounted above wrench means 167 on the mast 3; it comprises a fluid cylinder 183 that extends laterally of the mast and the drilling axis A and is fixed to member 71 at the rear of the mast, and has a piston rod 184 carrying at its outer end drill rod-engaging means 185. Means 185 comprises a flexible chain 186 fixed to a holding member 187 mounted on rod 184 and having a concave curved surface 188 shaped to fit and mate with the outer curved surface of the drill rod and also an arcuate channel 189 adapted to receive the outer end of chain 186. The arc of channel 189 is formed around a radius extending through the axis of the drill rod when the member 187 engages the rod. The cylinder 183 is located to a side of the drill rod so that when its piston rod is extended and chain 186 is in channel 189, and member 187 bears against the drill rod as shown in FIG. 33, the rod and chain are substantially tangential to channel 189. The holding member 187 also includes a rigidly mounted latch portion 190 that is adapted to fit closely in one of the longitudinal slots 118 as the lower end of a drill rod, as shown in FIG. 33.

Cylinder 183 is connected by suitable known conduits 191 to the fluid pressure unit 28 and to control means either in cab 9 or at a suitable location near the cylinder.

When it is desired to loosen the threaded joint between a lower drill rod R and an upper drill rod immediately above it, the lower drill rod is located and then engaged by wrench means 167 to prevent unthreading rotation of the rod, as previously described. Piston rod 184 of loosening mechanism 182 is then extended, and holding member 187 manually placed so its curved surface 188 contacts the outer surface of the upper drill rod and so its latch portion 190 extends into a lower slot 118 of the upper drill rod remote from cylinder 183 of means 182. Cylinder 183 is then controlled to retract the piston rod 184, thus causing the upper drill rod R to rotate in an unthreading direction while the lower drill rod is prevented from rotating, so that the threaded joint between the drill rods is loosened. The upper drill rod can then be completely disconnected from the lower drill rod by further rotation and movement of the drilling head, while the lower drill rod is held by wrench means 167 as previously described.

The apparatus includes conventional means, not shown, for locking the mast 3 in its upright position. The apparatus also includes conventional conduit means for supplying hydraulic fluid under pressure from pressurizing unit 28, to cylinder 40 for raising and lowering the mast 3, to cylinders 107 of the crowd mechanism 96 for raising and lowering the drilling head 4 on the mast, to cylinder 124 for rotating shaft 123 and swinging rack 127 about axis X on the mast, to fluid motor 161 for actuating the geneva wheel mechanism to rotate rack 127 about its axis Y, and to cylinder 183 of loosening means 182. The apparatus also includes known control means operated from cab 9, and from other locations if desired, for controlling the operation of each of the above indicated hydraulic fluid powered elements. The apparatus also includes conventional means for supplying air under pressure from compressor 27 to the drilling head 4 from which it passes into the drill rods connected to the drilling head, and for controlling the flow of such air from cab 9. Controls for controlling operation of engine 15 are also in cab 9 as well as in cab 14.

Suitable known means, not shown, is also provided to limit the travel of the drilling head at the upper and lower ends of its path of travel on the mast 3.

The apparatus can be adapted to handle drill rods of smaller diameters by inserting suitable adapter sleeves in cups 130 of lower rack member 129, and inserting into slots 143 of upper rack member 142 suitable adapter elements having smaller slots and necks; if the thread size of the drill pipe is smaller, a suitable spindle member 89 can be replaced on the drilling head with a spindle member having a suitably smaller thread.

Operation

The above apparatus of FIGS. 1–34 may be operated as follows, assuming that the apparatus has been moved to the desired location, that the jacks 13 have been extended to level the apparatus, that the mast has been raised to its upright position and locked in that position, and that gear box 18 is set to transmit power to the drilling means and not to the wheels of the vehicle. It is also assumed that rack 127 contains the maximum number of drill rods, four in the illustrated embodiment, positioned in the rack with their lower ends in cup members 130 of lower member 128 and with their upper larger diameter portions, those above reduced portions 116, extending through slots 143 of upper member 142 of the rack that are aligned with the cup members in which the rods are located, these larger diameter portions of the drill rods having diameters larger than the necks 146 of the slots 143 so that the upper portions of the drill rods are secured against lateral movement out of the slots in the rack (FIGS. 1, 2, 6, 19, 28). There is also another drill rod connected to the spindle member 89 of the drilling head 4; this rod has cutter bit H.

Engine 15 is then started and controlled to operate at low speed, transmission 16 is shifted to low speed to provide power in the direction of rotation proper for drilling, and clutch 36 is actuated to cause driving bar 6 to actuate driving head 4 to rotate the drill rod in drilling direction.

The crowd mechanism 96 for moving the drilling head 4 longitudinally along the mast, is then actuated at low pressure and slow speed until the bit H contacts the earth. The air is then turned on to supply pressurized air to the drill rod connected to the drilling head, and the speed of rotation of such rod is increased by increasing the speed of the engine, and the speed of movement downwardly of the drilling head 4 is increased by increasing pressure in cylinders 107 of mechanism 96 to achieve desirably rapid penetration. As drilling progresses, the air passes downwardly through the drilling head, member 89, the connected drill rod, and bit H into the drilled hole and then upwardly around the drill rod and out of the drilled hole into shroud 8 carrying with it, from the drilled hole, dust and other debris, that is collected in the shroud.

After the drilling head 4 has traveled downwardly to its maximum length of stroke, and if it is desired to add another drill rod, the air to the drill rod connected to head 4 is shut off and the drilling head raised out of the drilled hole until the upper reduced portion 111 of the rod is in the position shown in FIGS. 31, 32, where portion 111 can be engaged as described above by the drill rod engaging member 170 of the lower wrench means 167. Transmission 16 then is shifted to reverse the direction of rotation at slow speed, causing the drill rod to rotate in the unthreading position and causing latch member 175 of member 170 to engage slot 113 in the drill rod and halt its rotation. By manipulation of clutch 36 the spindle member 89 is caused to continue to rotate, thus loosening the joint between the drill rod and the spindle member and causing it to begin to unscrew from the thread at the top of the drill rod. Hydraulic fluid at low pressure is applied to cylinders 107 of mechanism 96 to cause the drilling head to raise slowly and allow the spindle member 89 to unscrew from the drill rod without binding. After the spindle member has completely separated from the drill rod the drilling head is rapidly raised to the top of its travel on the mast.

While the drilling head is thus moving up on the mast, transmission 16 is shifted to low speed in the drilling direction of rotation, and preferably suitable joint compound is applied to the thread of the drill rod held by the lower wrench means.

Rack 127 is then caused to move by actuation of mechanism 150 to bring a selected one of the drill rods R in the rack into proper position to be connected to the spindle member after the rack is swung about axis X as follows. The rack then is swung about axis X by actuation of cylinder 124 so that the selected drill rod which had been moved by geneva mechanism 150 will be located under and coaxially with spindle member 89 of drilling head 4, the rack being firmly located in such position by engagement, with notch 164, of the projection 163 on member 129 of the rack corresponding to the selected drill rod. Clutch 36 is then engaged to cause the drilling head spindle member 89 to rotate at low speed and the drilling head is lowered by low pressure in the cylinders 107 of crowd mechanism 96 to cause the female thread of the spindle member to engage the male thread at the top of the selected drill rod in the rack. The weight of the drill rod and resisting friction between the drill rod and the rack holds the drill rod against rotation with the threaded joint between spindle member 89 and the rod is tight. After such threaded joint is tight the drill rod will rotate in its cup member 130 by ratcheting action between slots 118 in the lower portion of the rod and the latch member 136 of the cup.

After the joint is tight, which is indicated by the ratcheting action, drilling head 4 is raised to raise the spindle member and its selected drill rod from the rack to a position where the reduced portion 116 at the upper portion of the drill rod is aligned with the neck 146 of the slot in upper member 142 of the rack in which the drill rod is disposed. The lower curved ends of slots 118 at the lower end of the rod facilitate disengagement of the latch member of the cup as the rod is thus raised. Cylinder 124 is then actuated to cause the rack 127 to swing back about axis X to its retracted position, clearing the drill rod which is located at this time so that its reduced portion 111 clears the neck 146 of the slot in member 142 of the rack and the lower end of the rod clears the top of the associated cup members 130.

With the rack thus retracted, the drill rod attached to the spindle member 89 is then rotated in the threading position, clockwise in the illustrated embodiment, while being lowered so that its female thread at the bottom of the drill rod engages the male thread at the top of the drill rod held by wrench means 167. When the joint between these drill rods is tight, member 171 of wrench means 167 is retracted to release the lower drill rod, and the apparatus is then in condition for continued drilling.

Transmission 16 is then shifted to the desired gear, the air pressure is turned on to supply air through the connected drill rods which are so tightly connected that there is no air leakage. The engine speed is brought up to drilling speed, clutch 36 engaged to rotate the thus connected drill rods, and the pressure in cylinders 107 of mechanism 96 is increased and adjusted as necessary to cause the cutter bit to penetrate the earth and drill the hole. This procedure may be continued as long as desired, drill rods being thus connected to form a drill string as long as drill rods are available in the rack 127 for the desired depth of hole.

After the desired depth of drilling has been achieved and it is desired to remove the drill rods from the drill string, the following procedure may be followed. Drilling head 4 and its attached string of drill rods is raised on the mast to the location where wrench means 167 may be engaged as described above with reduced portion 111 at the upper end of the lower drill rod that is attached to the bottom end of the upper drill rod connected to the spindle member 89 of the drilling head member 170. The air pressure is shut off. Clutch 36 is disengaged to halt rotation of the drill rods. Wrench means 167 is then engaged with the stationary lower drill rod at its reduced portion 111 as described above. Piston rod 184 of loosening means 182 is then extended and its holding member 187 is manually appropriately adjusted to contact the surface of such drill rod and to have its latch portion 190 extend into the appropriate slot 118 at the lower end of the upper drill rod that is connected to the spindle member. Piston rod 184 is then retracted in its cylinder to loosen the joint between the upper drill rod and the lower drill rod; if necessary one or two additional manual connections may thus be made between the means 182 and the drill rod to achieve desired loosening. Member 187 and latch 190 are then disconnected from the upper drill rod. Transmission 16 is then shifted to reverse rotation of the spindle member 89, clutch 36 is engaged, and the drill rod connected to the spindle member is unthreaded from the lower drill rod held by wrench means 167, while the drilling head is slowly raised with low pressure in cylinders 107 to permit ready unthreading without binding.

After the upper drill rod still connected to the spindle member 89 is completely disconnected from the lower drill rod, it is raised upwardly by the drilling head 4 on the mast to the height mentioned below. Rack 127, which if necessary had been previously rotated by mechanism 150 about rack axis Y, is swung about axis X to bring an empty slot 143 of member 142 and its aligned empty cup member 130 of member 129 into alignment with the drill rod supported by the drill spindle, the height of the drill rod having been previously adjusted so that the neck of the empty slot 143 can pass around the reduced portion 116 near the upper end of the drill rod so that the drill rod can completely enter the slot 143. Drilling head 4 is then slowly lowered while the drill rod connected to the spindle member is rotated in reverse or unthreading position, or counterclockwise in the illustrated embodiment. Such lowering is continued until the lower end of such drill rod bottoms in the cup member 130 aligned with the rod, and the upper enlarged portion of the drill rod above its reduced portion 116 moves axially of the rod into the inner portion of the slot 143, so that such upper portion of the drill rod cannot pass laterally out of the slot and the upper portion of the rod is thus secured against movement laterally relative to the rack. As rotation of the spindle member and rod is continued, the latch member 136 of such cup member engages the longitudinal wall 119 of one of the slots 118 at the lower end of the drill rod, thus halting rotation of the rod. Continued rotation of the spindle member 89 by the drilling head unscrews the spindle member from the upper end of the drill rod in the rack; as the spindle member is rotated it is desirable that the drilling head be raised slowly to provide the proper unscrewing action without binding. After spindle member 89 is completely disconnected from the drill pipe, the drilling head 4 is moved to its extreme upper position on the mast, and rack 127 is swung about axis X out from its position under the spindle member and to its retracted position.

The drilling head is then moved down on the mast with fast travel, while the transmission 16 is shifted to slowly rotate the spindle member in the threading or clockwise direction in the illustrated embodiment. The spindle member then is threaded onto the end of the drill rod that is held by wrench means 167, while the spindle member is moved downwardly with low pressure in the cylinders of mechanism 96. After the thus formed threaded joint is tight, the wrench means is disconnected from the lower drill rod. If additional drill rods are to be disconnected, the procedure described above is repeated until all previously connected drill rods are thus removed and placed in the rack. In each case, after rack 127 has been retracted, the actuating mechanism 150 is caused to rotate the rack about its axis Y to bring a proper empty cup member 130 and aligned empty slot 143 into position so that when the rack is moved forward about axis X such empty cup member and slot can be aligned with the drilling axis to receive another drill rod.

Various modifications may be made in the apparatus and methods of operation described above.

FIGS. 35–38 illustrate a modified disconnectible driving unit 193 that may be used in place of driving unit 45 of the previously described embodiment, to provide driving action between output shaft 44 of the driving means mounted on the frame 10 of the vehicle 1, and stub shaft 48 of right angle gear box 7 that rotates driving bar 6 to cause drilling head 4 to rotate the drill rods in the drill string.

Unit 193 comprises a female driving member 194 mounted on output shaft 44 and adapted to be engaged with and to drive a male driven member 195 fixed to shaft 48 of gear box 7 on mast 3. Member 194 comprises housing 196 rigidly mounted on shaft 44. An annular stop member 197 is clamped to the front of the housing by bolts 198. An axially moving movable driving element 199 is slidably mounted on bolts 198 and biased by spring 200 towards member 197 which limits travel of element 199. Element 199 has an opening 201 therethrough the star-shaped opening with eight corners 202 illustrated being found advantageous. The opening has beveled front edges 203 at the front face 204 of element 199.

Figure 36:
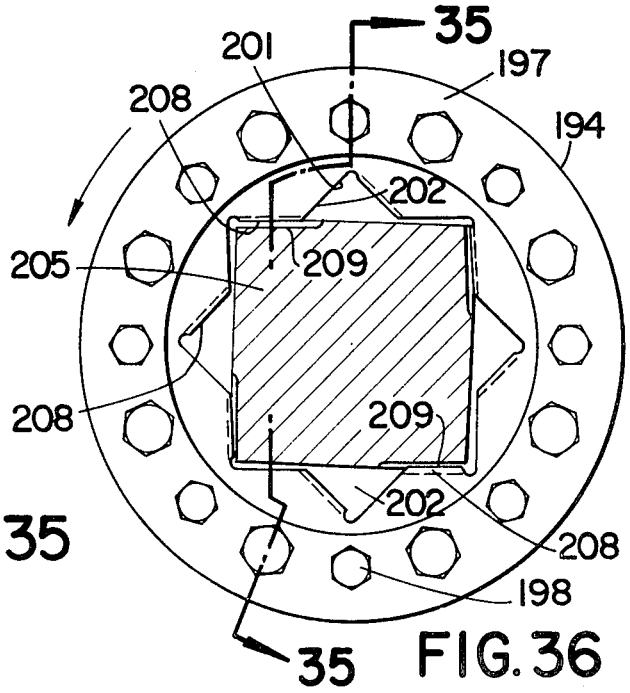
FIG. 36 is a section along line 36—36 of FIG. 35.

Driven member 195 has a projecting portion 205 with a front end 206 and an axially extending exterior contour 207 that in this embodiment is generally square in cross section and proportioned so that when portion 205 is fully inserted into opening 201 of element 199, its four corner portions extend into four of the corners 202 of opening 201 as shown in FIG. 36. The contour of opening 201 is such that portion 204 can fit in any group of alternate corners 202. Consequently, as the mast 3 is raised to its upright position, portion 205 of member 195 engages movable driving element 199 of driving member 194. If it should happen that the contours of opening 201 and of portion 205 are angularly aligned as in FIG. 36, then portion 205 will immediately fully enter opening 201. However, if they are not in such angular positions, as will usually be the case, end 206 of portion 205 and face 204 of 199 will contact and element 199 will be forced axially inwardly of housing 196 as the mast moves to its final upright position and the axis of driven member 195 aligns with that of driving member 194. Then, as member 194 rotates as power is supplied and clutch 36 is engaged, portion 205 of driven member 194 will snap into the opening 201 of driving member 193 and provide positive driving engagement between the driving and driven members and hence positive rotation of the driving bar 6 as described above.

In order to insure that the driving and driven members will not inadvertently disconnect under load, particularly if the engaging surfaces of element 199 and portion 205 wear over a period of time, the inner surfaces of opening 201 of driving element 199 that engage the outer surfaces of the corners of projecting portion 205 of driven member 195 as the parts rotate under drilling load, are shaped to provide a backdraft or inclination of each of such surfaces relative to the axis of the members when engaged.

Figure 35:
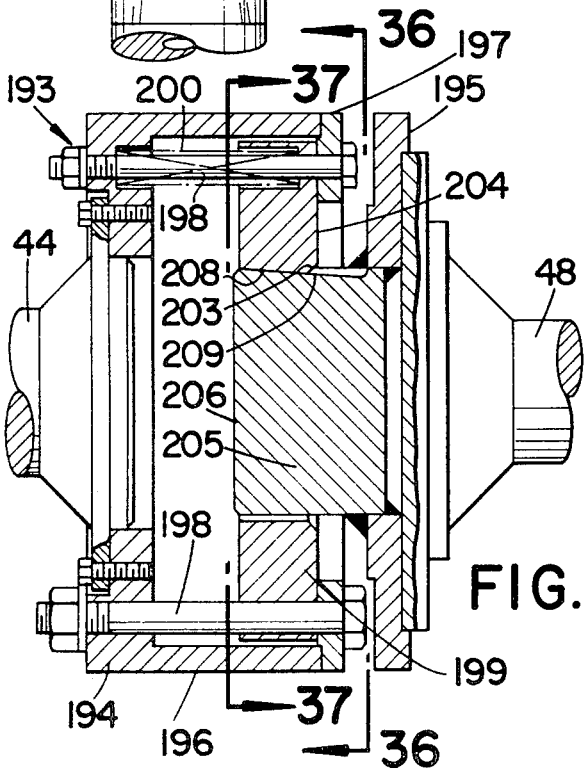
FIG. 35 is a section along line 35—35 of FIG. 36, showing another means for forming a separable driving connection between the drive means on the vehicle and that on the mast, and that can be used in place of the means shown in FIGS. 11 and 12.
Figure 37:
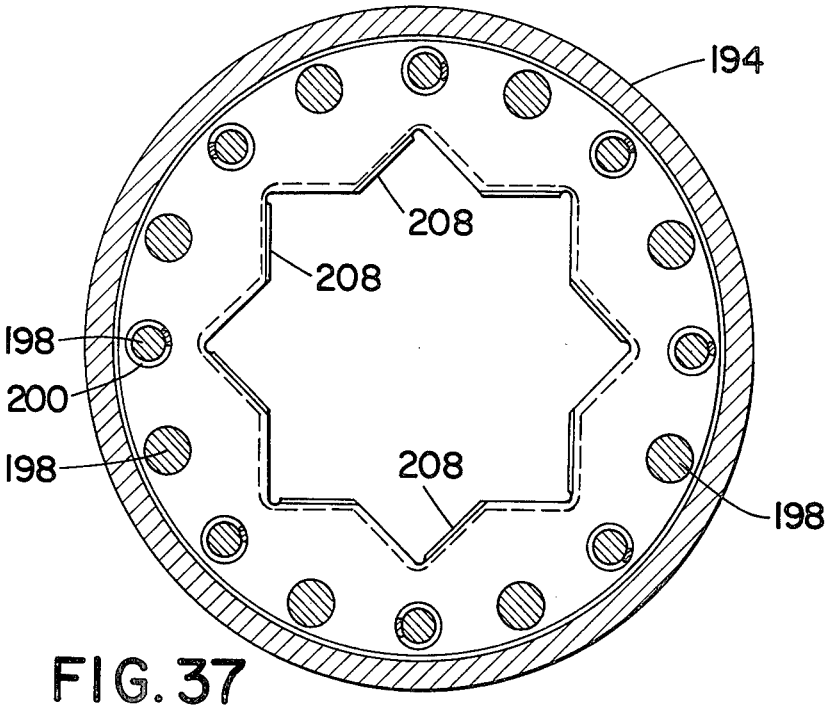
FIG. 37 is a section along line 37—37 of FIG. 36 and to a larger scale.

Thus, as shown in FIGS. 35, 36, 37, in driving element 199 the surfaces 208 of the re-entrant corners 202 of the opening 201 that engage the outer surface of portions 209 of the projecting portion 205 of driven member 195 when the parts are rotating while under driving load, are inclined slightly to the axis of driving member 194 from front face of element 199 rearward and outwardly of element 199, so that at these surfaces opening 201 enlarges from the front to the rear of element 199.

Figure 38:
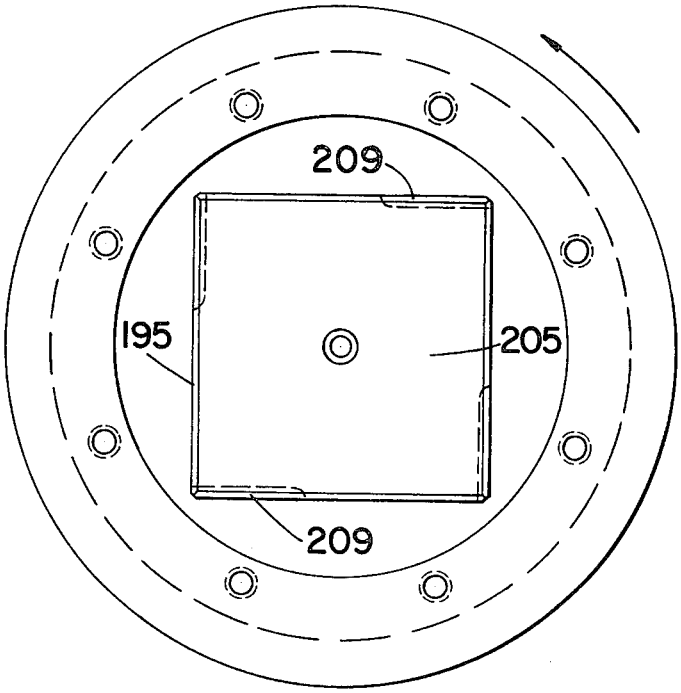
FIG. 38 is an end view to the scale of FIG. 37 of the projecting portion of the driven member of FIG. 35.

The surface portions 209 at the corners of projecting portion 205 of driven member 195 are inclined from the front end 206 of the portion inwardly toward the rear of the member, as shown in fIGS. 35 and 38.

Consequently, when members 194 and 195 are engaged under load, the contacting inclined surfaces 208 of the driving element 199 and surfaces 209 of portion 205 of driven member 195 cooperate to exert axial components of forces on the engaged parts that tend to hold them in engagement. Any tendency of element 199 under load to move axially in housing 197 away from member 195 to an extent where element 199 could disconnect from member 195 is therefore negated by the inclined engaging surfaces of these parts.

Figure 40:
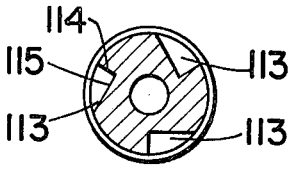
FIG. 40 is a section along line 40—40 of FIG. 39.
Figure 39:
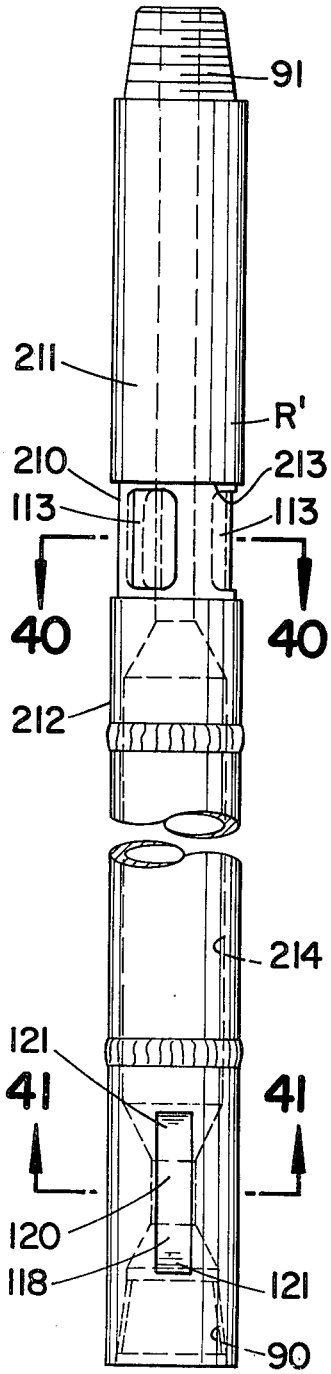
FIG. 39 is a side elevation of another form of drill rod embodying the invention that may be used in the drill string.
Figure 41:
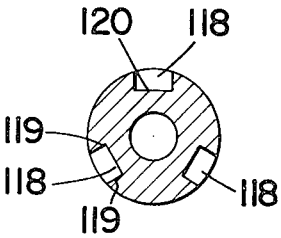
FIG. 41 is a section along line 41—41 of FIG. 39.

Another modification of the invention that may be used is the drill rod R′, shown in FIGS. 39 to 41 inclusive. This drill rod is substantially similar to that shown in FIGS. 19 to 21 of the embodiment described above, except there is a single reduced or recessed portion 210 near the upper end of the drill rod, and no other portion of reduced cross section, other than lower slots to be described later, in the body of the rod between its end threads 90 and 91. This reduced portion is of a diameter less than the diameter of the cylindrical portion 211 above the drill rod and portion 212 below the drill rod. Reduced portion 210 has an upper shoulder 213 between portion 210 and upper larger portion 211, and also has spaced elongated slots 113 with radial and inclined walls 114 and 115, that in this embodiment are identical in shape and spacing with slots 113 of reduced portion 111 of the embodiment of FIGS. 19 to 22, as is apparent from FIGS. 39, 40. The drill rod also has lower slots 118 identical with slots 118 of the previous embodiment, each slot having parallel side walls 119, and a bottom 120 with curved ends 121. An internal passage 214 extends entirely through the drill rod. The rod also has, as in the previous embodiment, upper male threaded portion 91 and a matching lower female threaded portion 90.

In this drill rod, reduced portion 210 performs the functions of both reduced portions 111 and 116 of the drill rod R of FIGS. 19 to 22 inclusive. That is, reduced portion 210 is of a diameter sufficiently small to enable it to pass laterally through the neck portion 146 of any of the slots 143 of upper member 142 of the rack 127, and portion 211 above reduced portion 210 of such larger diameter that such portion fits closely but slidably within inner portion 145 of each slot 143 but cannot pass through the neck 146. Consequently, when there is a proper dimensional relationship between drill rod R' and the lower and upper transverse supporting members 129 and 142 of the rack 127, the drill rod can be held in an aligned cup member 130 and slot 143 of the rack, and when rod R' is lifted as described above in connection with prior rod R, the rack can be moved laterally so the rod passes out of the slot 143 through its throat 146 to permit lateral disengagement of the upper portion of the rod R' from the rack in a manner similar to that described previously. Furthermore, reduced portion 210, and its associated shoulder 213 and slots 113, of drill rod R' can be used to support the drill rod when it is in the earth by wrench means such as the wrench means 167 of FIGS. 31 and 32 in a manner described previously in connection with drill rod R.

Drill rod R' in some respects can be more advantageous than prior drill rod in that it is simpler to manufacture and has a somewhat greater strength because there is only one reduced portion near its upper end.

Drill rod R' may be operated in connection with loosening means 182 on the mast by use of the elongated slots 118 at the lower portion of the drill rod, as described previously in connection with drill rod R of FIGS. 19 to 22. Slots 118 can also be used to prevent rotation of the rod in one direction by engagement with a latch member when the lower end of the rod is in a cup member of the lower transverse supporting member of drill rod rack 127, as previously described.

Another modification that may be used involves a somewhat different construction of the lower transverse supporting member of the rack. In this modification (FIGS. 42–45) the lower transverse supporting member 216 fixed to shaft 128, is essentially similar to member 129 shown and described in connection with FIGS. 26 and 27, except that the upwardly open cup members are somewhat different. These cup members 217 in this embodiment are of the same general diameters, heights and spacing as cup members 130 of the previous embodiment, and each has a flared upper edge.

Each cup member 217 has between its open upper end and its closed lower end a generally rectangular opening 218 (FIGS. 42, 44). A latch member 219 is pivotally mounted on the exterior of the cup member adjacent such opening for lateral movement. The latch member is supported by pivot pin 220 the ends of which are fixed in spaced parallel supporting members 221 fixed to the exterior of the cup member, the latch member being located between and guided by such members for movement in a lateral path normal to the axis of the cup member. The latch member is biased toward the cup member by a spring 222 surrounding pin 220 and engaging the latch member and a stop member 223 extending through the supporting members.

Latch member 219 has an inwardly projecting portion 224, having a generlly radial stop surface 225, that can extend through opening 218 into cup member 217, and an external stop portion 226 adapted to engage the exterior of cup member and limit inward travel of the latch member. The latch member also includes an inclined side surface 227 (FIGS. 43, 44, 45) extending from the extremity of stop surface 225 outwardly toward its pivoted end. Furthermore the inwardly projecting portion 224 has a surface 228 inclined downwardly and inwardly toward the juncture of surfaces 225 and 227, approximately 45° from the vertical in the illustrated embodiment, to permit the latch member to be forced outwardly to clear the interior of the cup member when the bottom end of a drill rod is inserted into the cup member.

The dimensions and shape of the latch member are such that the stop surface 225 of the latch member can engage a side of the lower slot 118 of a drill rod R or R' in the cup member and prevent its rotation in a counterclockwise direction, to permit the drill rod to be held against rotation when the spindle member 89 is being unthreaded from the drill pipe as previously described; and also to permit the drill rod to rotate clockwise by ratcheting of the latch member as necessary by contact of the drill rod with side surface 227 when the spindle member 89 is being threaded onto the top end of a drill rod while its inner end is in the cup member, as described above.

Moreover, the pivot pin 220 has transverse notched or reduced portions 229 (FIG. 44) that permit the latch pin to break by shearing at either or both of these locations and cause the latch member 219 to disengage from the drill rod to prevent damage to the apparatus, in the event that the threaded joint between the upper end of the drill rod and the spindle member 89 should be so tight that it will not readily come unthreaded when the spindle member is rotated in the unscrewing direction, and in the event that another torque limiting element such as torque limiting coupling 42 does not operate to limit the torque exerted by the rod to below that exceeding the maximum load predetermined by the pin. Such shearing action therefore provides an added safety factor in preventing harmful damage to the apparatus. Shear pin 220 can be readily replaced, and the latch member readily re-installed, in the event the pin is thus broken under overload.

It is apparent that various other modifications may be made in the apparatus and methods of operation described above. Thus, different types of drill rod than those illlustrated may be used in connection with a rack rotatable by geneva wheel mechanism according to the invention, although the drill rods illustrated provide particular advantages. A different structure of the mast may be used. Different means for applying power to the drilling head may be used, although the means of the invention for directly applying mechanical power to the drilling head for rotating the drill rods during drilling is particularly advantageous because it prevents slippage of the power means or stalling of the drill rods as can occur when a fluid powered drilling head is used and higher drilling resistance is encountered, which slippage or stalling impairs the drilling operation. Modifications may be also made in the mobile vehicle. Features of the invention such as the rack structure can be used in connection with other types of drilling apparatus than mobile drilling apparatus.

Other modifications than those indicated above may be made.

While the invention has been shown and described with respect to specific embodiments thereof, this is intended for the purpose of illustration rather than limitation; and other variations and modifications of the specific devices and methods of operation herein shown and described will be apparent to those skilled in the art, all within the intended spirit and scope of the invention. Accordingly, the patent is not to be limited to the specific devices or methods of operation herein disclosed nor in any way that is inconsistent with the extent to which the progress of the art has been advanced by the invention.

What is claimed is:

1. Apparatus for drilling holes downwardly into the earth comprising a wheeled vehicle having a frame; a drilling mast mounted on said frame for pivotal movement, between an upright drilling position and lateral position, about a first axis fixed with respect to said vehicle frame; a driving bar extending longitudinally of and supported by said mast for rotation about a second axis fixed relative to said mast; driving head means on said mast for rotating a drill rod when said mast is in said upright position, said driving head means being supported on said mast for movement upwardly and downwardly thereof when said mast is in said upright position, said driving head means comprising a rotatable spindle member adapted to rotate a drill rod and to be connected to and disconnected from a drill rod, and means slidably but non-rotatably engaging said driving bar means to positively rotate said spindle member from said driving bar; power means carried by said vehicle frame and adapted to drive a drive shaft rotatably mounted on said frame for rotation about a third axis fixed with respect to said frame and extending transversely toward said mast when it is in its upright drilling position; and disconnectible driving means between said drive shaft on said vehicle frame and said drive bar on said mast, said driving means comprising a driving member having a free end and rigidly connected at its other end to said drive shaft and a driven member having a free end and rotatably mounted on said mast for rotation about a fourth axis fixed with respect to said mast and located to coincide with said third axis when said driving and driven members are connected in driving engagement, said driven member being connected at its other end for positive rotation to said driving bar, said driving and driven members being adapted to be connected at their free ends in driving engagement with said third and fourth axes coinciding when said mast is in its upright drilling position and to be disconnected when said mast is in its lateral position, said driving and driven members being adapted to automatically connect in driving engagement when said mast is in its upright position and to automatically disconnect when said mast is moved from its upright position, one member of said driving member and said driven member comprising an apertured mating portion having an aperture of polygonal cross section and said other member of said driving member and said driven member comprising a projecting mating portion of polygonal cross section matching that of said aperture and adapted to enter into said apertured mating portion to provide driving engagement between the driving and driven members, the mating portion of one member of said driving member and said driven member being adapted to move axially but non-rotatably relatively to a remainder of such member and being biased for movement toward the free end of said member but being capable of being moved axially away from the free end of said member when the mating portion of the other member contacts it in non-mating angular relation as said mast is moved to its upright position, said axially movable mating portion being adapted when said mating portions reach mating angular relation on rotation of said driving member to move toward the free end of the member of which it is a part so that said apertured mating portion receives in its aperture the projecting mating portion of said other member to provide positive driving engagement between said driving and driven members.

2. The apparatus of claim 1 in which said apertured mating portion is movably axially of the member of which it is a part.

3. The apparatus of claim 1 in which said apertured mating portion is movable axially of and forms part of said driving member.

4. The apparatus of claim 1 comprising a drive shaft for driving said vehicle from said power means, and means for selectively supplying power from said power means either to said drive shaft for driving said vehicle or to said drive shaft that is adapted to be connected to drive said driving bar means.

5. Drill rod storage apparatus for earth drilling apparatus comprising a base; a support mounted on said base for lateral movement relative to said base; a rack mounted on said support to rotate about an axis of said rack independently of lateral movement of said support, said rack including a plurality of drill rod holding means for holding a plurality of drill rods in said rack; and means for rotating said rack about its axis to move each of said drill rods individually to, and halt it at, a predetermined angular position about said rack axis, said means for rotating said rack comprising a geneva star wheel rigidly connected to said rack for rotation therewith about said rack axis, said star wheel having a plurality of outwardly opening raial slots each associated with one of said drill rod holding means and locking shoulder means between said slots, rotatable drive means rotatable about an axis spaced from and fixed relative to said rack axis of said rack and having crank arm means carrying slot-engaging means radially spaced from said rack axis and also having surface means adapted to engage said locking shoulder means on said star wheel, said slots on said star wheel being located relative to said drill rod holding means so that when said driving means is rotated said slot-engaging means engages one of said slots and rotates said star wheel and said rack to move an individual drill rod held in the drill rod holding means associated with said slot into said predetermined angular position, said locking shoulder means on said star wheel and said shoulder engaging means on said driving means being adpated to engage and lock said star wheel in said predetermined angular position after such rotation of said driving means and of said star wheel and said shoulder means.

6. The apparatus of claim 5 in which said holding means on said rack is adapted to support a plurality of drill rods in spaced parallel relation to each other and to said axis of said rack.

7. The apparatus of claim 5 comprising means operating between said base and said rack for maintaining said rack in a predetermined position relative to said base after said rack has been rotated to bring a drill rod holding means into said predetermined angular position and after said rack has been moved laterally by said support to said predetermined position relative to said base.

8. The apparatus of any of claims 5, 6, or 7 in which said drill rod holding means comprises socket means adapted to receive the lower end of said drill rod, and laterally movable latch means that is adapted to engage said drill rod to prevent rotation of said drill rod in said one angular direction and that also is adapted to permit axial movement of said drill rod when said drill rod enters said socket means or leaves said socket means.

9. The apparatus of any of claims 5, 6, or 7 in which said drill rod holding means comprises socket means adapted to receive the lower end of said drill rod, and laterally movable latch means that is adapted to engage the portion of said drill rod to prevent rotation of said drill rod in said one angular direction and that also is adapted to permit axial movement of said drill rod when said drill rod enters said socket means or leaves said socket means, said latch means being biased for movement toward said drill rod in a path extending transversely of said drill rod.

10. The apparatus of any of claims 5, 6, or 7 in which said drill rod holding means comprises socket means adapted to receive the lower end of said drill rod, and laterally movable latch means that is adapted to engage said drill rod to prevent rotation of said drill rod in said one angular direction, said latch means being movable in an essentially straight path between an extended position in which it so engages said drill rod and a retracted position in which it does not so engage said drill rod, said latch means being biased for movement in said path toward said extended position.

11. The apparatus of any of claims 5, 6, or 7 in which said holding means comprises socket means adapted to receive the lower end of said drill rod, and laterally movable latch means that is adapted to engage said drill rod to prevent rotation of said drill rod in said one angular direction, said latch means being movable in a substantially curved path between an extended position in which it engages said drill rod and a retracted position in which it does not so engage said drill rod, said latch means being biased for movement in said path toward said extended position.

12. The apparatus of claim 8 comprising overload means holding said latch means against force exerted on said latch means by said drill rod while said latch means prevents rotation of said drill rod in one angular direction, said overload means being adapted to release said latch means and said drill rod if said force exceeds a predetermined magnitude.

13. A drill rod for use in earth drilling apparatus comprising an elongated body having at one end an external thread and at the other end an internal thread, said body when the drill rod is upright in drilling position having an upper portion of larger cross section and, below said portion, a reduced portion of smaller cross section, said reduced portion defining at its upper end a generally radially extending shoulder between said upper portion and said reduced portion, said reduced portion having at least one recess having a generally radially and axially extending wall and, intersecting said wall, another wall extending to the outer periphery of said reduced portion, said rod body also having adjacent the lower end of the rod at least one lower recess that is an elongated slot having two generally parallel, generally axially and generally radially extending walls and a bottom that gradually slants upwardly to the exterior surface of said rod at the lower end of said slot at least one of said radially extending walls in said recess being disposed relatively to the threads on the end of the rod so that when said wall is engaged by a stop member the rod is prevented from rotating when a threaded other rod or drilling head spindle is rotated to unscrew it from a thread on said rod.

14. The drill rod of claim 13 in which in the upper portion of said rod when it is in said upright position there is a second reduced portion in said rod body spaced from said first reduced portion by an intermediate portion that has a larger cross section than that of said second reduced portion which cross section is uniform for a substantial portion of its length beginning at the upper end of said second portion of reduced cross section.

15. The drill rod of claim 13 in which when the drill rod is in said upright position said axially extending reduced portion is the only reduced portion in the drill rod body between its threaded ends except for said lower recesses.

16. The drill rod of claim 13 in which in said reduced portion of said rod having a recess there are a plurality of said recesses substantially equiangularly spaced around said reduced portion.

17. The drill rod of claims 13 or 16 in which there are a plurality of said lower recesses substantially equiangularly spaced around the lower portion of the rod body.

18. The drill rod of any of claims 13, 14, 15, or 16 in which said reduced portion having said recess is of generally cylindrical configuration and in which the other axially extending portions of the rod body are of generally cylindrical configuration between said threaded ends except for each said lower recess.

19. Apparatus supported from a drill platform for supporting and holding against rotation a drill rod, said drill rod having a reduced portion providing a downwardly facing radial shoulder and below said shoulder a recess in the rod providing a stop surface which when engaged by a stop member will prevent rotation of said rod, in the direction toward the stop member, said apparatus comprising a drill rod-engaging member supported from said platform for movement in a guided path between an extended position and a retracted position, said drill rod-engaging member having a recess extending inwardly from an edge of said member and shaped to receive said reduced portion of said drill rod and to engage under said shoulder on said drill rod to support said drill rod when said drill rod-engaging member is in its extended position, said drill rod-engaging member carrying a stop member adapted to move in a fixed path on said drill rod-engaging member to an extended position where said stop member projects into said recess in said drill rod and engages said stop surface to prevent rotation of said drill rod in the direction toward said stop member; and means for moving said drill rod-engaging member to its extended position so its recess receives said reduced portion of said drill rod and said drill rod-engaging member engages said drill rod under said shoulder on said drill rod to support said drill rod and in which said stop member extends into said recess in said drill rod, and to a retracted position in which said drill rod-engaging member and its stop member are completely free of and clear said drill rod.

20. The apparatus of either claim 16 or 17 in which said stop member of said drill rod-engaging member is biased on said drill rod-engaging member for movement to the extended position of said stop member, and in which said stop member can be forced to its retracted position when engaged by the surface of the reduced portion of the drill rod outside of said recess in the drill rod.

21. The apparatus of either claim 19 or 17 in which the recess of said drill rod-engaging member is adapted to engage a reduced portion of the drill rod that is of circular cross section except for said recess in said portion of said drill rod, and in which said stop member on said drill rod-engaging member has a stop surface that extends generally radially of the drill rod and is adapted to engage a generally radial stop surface in said recess in said drill rod and in which said stop member has an end surface that extends transversely of said drill rod and is shaped to be engaged by a second surface in said recess intersecting said stop surface in said recess to force said stop member inwardly to its retracted position when said drill rod is rotated in a direction opposite to the direction of rotation in which the drill rod is halted when the stop surface of said recess in the drill rod engages the stop surface on said stop member of said drill rod-engaging member.

22. Apparatus for loosening a threaded joint between and connecting together an upper drill rod and a lower drill rod one of which is held against rotation while the other drill rod is rotated in unthreading direction, said other drill rod having at least one recess therein having a wall that extends axially and generally radially of said drill rod, said apparatus comprising drill rod-holding means adapted to be attached to said drill rod and having a surface shaped to fit transversely the outer surface of the drill rod for a portion of its circumference and having a portion adapted to project into said recess and engage said wall in said recess of said drill rod, a flexible member connected to said drill rod-holding means which flexible member lies in a channel in said drill rod-holding means and provides an arcuate guide that is radially arcuate about the center of said drill rod, and means for exerting a force on said drill rod-holding means to rotate said drill rod to loosen the threaded joint connecting together said drill rods, said force-exerting means being connected to said flexible member and including a member that moves between an extended position in which said drill rod-holding means can be attached to said drill rod and a retracted position in which said force-exerting means pulls said drill rod-holding means to rotate said drill rod to loosen said threaded joint connecting together said drill rods.

23. The apparatus of claim 17 in which said means for exerting a force on said drill rod-holding means is a member that moves between an extended position in which said drill rod-holding means can be attached to said drill rod and a retracted position in which it pulls said drill rod-holding means to rotate said drill rod.

24. The apparatus of claim 23 in which said drill rod-holding means includes a flexible member connected to said force-exerting member and to said drill rod-holding means which flexible member lies in a channel in said drill rod-engaging means that provides an arcuate guide that is radially arcuate about the center of the drill rod.

25. Apparatus supported from a drill platform for loosening a threaded joint between an upper drill rod and a lower drill rod, said lower drill rod having near its upper end a reduced portion providing a downwardly facing radial shoulder and below said shoulder a recess in the rod providing a stop surface which when engaged by a stop member will prevent rotaion of said rod in the direction toward the stop member, and which upper drill-rod has adjacent its lower end a recess having a wall that extends generally axially and radially of said upper drill rod, said apparatus comprising: wrench means comprising a drill rod-engaging member supported from said platform for movement in a guided path between an extended position and a retracted position, said drill rod-engaging member having a recess extending inwardly from an edge of said member and shaped to receive said reduced portion of said drill rod and to engage under said shoulder on said drill rod to support said drill rod when said drill rod-engaging member is in ites extended position, said drill rod-engaging member carrying a stop member adapted to move in a fixed path on said drill rod-engaging member to an extended position where said stop member projects into said recess in said drill rod and engages said stop surface to prevent rotation of said drill rod in the direction toward said stop member, and means for moving said drill rod-engaging member to its extended position so its recess receives said reduced portion of said drill rod and said drill rod-engaging member engages said drill rod under said shoulder on said drill rod to support said drill rod and in which said stop member extends into said recess in said drill rod, and to a retracted position in which said drill rod-engaging member and its stop member are completely free of and clear said drill rod, said wrench means being extended to support and prevent rotation of said lower drill rod; and, above said wrench means, at a location where it can engage the lower portion of said upper drill rod, apparatus for loosening the threaded joint between said upper and lower drill rods comprising drill rod-holding means having a surface shaped to fit transversely the outer surface of the upper drill rod for a portion of its circumference and having a portion adapted to project into said lower recess on said upper drill rod and engage said wall in said recess of said drill rod, said drill rod-holding means also including means for exerting a force on said drill rod-holding means to rotate the upper drill rod to loosen the threaded joint connecting said upper drill rod to said lower drill rod.

* * * * *

UNITED STATES PATENT AND TRADEMARK OFFICE

CERTIFICATE OF CORRECTION

PATENT NO. : 4,258,796

DATED : March 31, 1981

INVENTOR(S) : Frederick G. Horning, John M. Pozniko and Karl H. Welch

It is certified that error appears in the above—identified patent and that said Letters Patent is hereby corrected as shown below:

Column 6, line 13, correct the spelling of --rigidly--.

Column 7, line 57, before "fixed" insert --is--.

Signed and Sealed this

*Eighteenth* Day of *August 1981*

[SEAL]

*Attest:*

GERALD J. MOSSINGHOFF

*Attesting Officer*

*Commissioner of Patents and Trademarks*